US010509345B1

(12) United States Patent
Ichiki et al.

(10) Patent No.: US 10,509,345 B1
(45) Date of Patent: Dec. 17, 2019

(54) IMAGE FORMING APPARATUS FOR CORRECTING CURL OF PAPER

(71) Applicant: FUJI XEROX CO., LTD., Tokyo (JP)

(72) Inventors: Yukihiro Ichiki, Kanagawa (JP); Kyogo Soshi, Kanagawa (JP); Akira Shimodaira, Kanagawa (JP); Sota Hara, Kanagawa (JP); Yosuke Ninomiya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 16/178,613

(22) Filed: Nov. 2, 2018

(30) Foreign Application Priority Data

Jun. 15, 2018 (JP) ..... 2018-114780

(51) Int. Cl.
*G03G 15/20* (2006.01)
*G03G 15/00* (2006.01)

(52) U.S. Cl.
CPC ..... *G03G 15/2028* (2013.01); *G03G 15/6576* (2013.01)

(58) Field of Classification Search
CPC ..... G03G 15/2028; G03G 15/6576
See application file for complete search history.

(56) References Cited

U.S. PATENT DOCUMENTS 4,013,357 A * 3/1977 Nakajima ..... G03G 15/6523 355/29
5,066,984 A * 11/1991 Coombs ..... B65H 29/52 162/171
6,002,913 A * 12/1999 Pawlik ..... B65H 29/70 162/271
7,299,000 B2 11/2007 Taira et al.
8,340,559 B2 12/2012 Kuroda et al.
2007/0147911 A1 6/2007 Hirota

FOREIGN PATENT DOCUMENTS

JP 04322280 A * 11/1992
JP 2006133377 5/2006
JP 2007178580 7/2007
JP 2011180230 9/2011

* cited by examiner

*Primary Examiner* — Susan S Lee
(74) *Attorney, Agent, or Firm* — JCIPRNET

(57) ABSTRACT

An image forming apparatus includes a fixing unit that transports a sheet of paper carrying an unfixed image through a nip part to fix the unfixed image to the sheet, a first guide unit coming into contact with a side of the sheet that guides transport of the sheet, and a second guide unit coming into contact with an opposite side of the sheet that guides transport of the sheet. The first guide unit has a recess serving as a guide part, the recess being recessed in a direction away from a transport path of the sheet. The second guide unit has a bending part serving as a guide part, the bending part having a shape of a circular arc in cross-section, the bending part being disposed such that at least a portion of the bending part lies inside the recess.

11 Claims, 18 Drawing Sheets

IMAGE FORMING APPARATUS FOR CORRECTING CURL OF PAPER

CROSS-REFERENCE TO RELATED APPLICATIONS

This application is based on and claims priority under 35 USC 119 from Japanese Patent Application No. 2018-114780 filed Jun. 15, 2018.

BACKGROUND

(i) Technical Field

The present disclosure relates to an image forming apparatus.

(ii) Related Art

Japanese Unexamined Patent Application Publications Nos. 2006-133377, 2007-178580, and 2011-180230 described below disclose image forming apparatuses according to related art that have a function to reduce deformation such as curling (curving or warping) or cockle that occurs in a sheet of paper after the sheet leaves a fixing unit.

Japanese Unexamined Patent Application Publication No. 2006-133377 describes an image forming apparatus including a fixing device positioned to transport a recording medium upward from a lower position against gravity. The fixing device includes a rotatable heat member such as a fixing roller with a heat source disposed therein, a rotatable pressure member such as a pressure roller disposed in pressure contact with the heat member to define a fixing nip part, and a paper-eject guide member that guides the recording medium to the outside of the image forming apparatus after the recording medium leaves the fixing nip part between the heat member and the pressure member. The paper-eject guide member has a guide surface intersecting a tangent line that is tangent to the heat member at the most downstream point of the fixing nip part. The angle of intersection between the guide surface and the tangent line is an obtuse angle.

Japanese Unexamined Patent Application Publication No. 2007-178580 describes an image forming apparatus including a paper feed device, an image forming unit, a fixing unit, and a discharge unit that discharges a sheet of paper to the outside of the image forming apparatus after the sheet undergoes a fixing process in the fixing unit. A paper-eject guide part of the discharge unit, which is located immediately downstream of a pair of fixing rollers of the fixing unit, is provided with a discharge-direction restriction unit that restricts the direction of discharge of the sheet to thereby correct the orientation of the sheet leaving the pair of fixing rollers.

Japanese Unexamined Patent Application Publication No. 2007-178580 also describes that the discharge-direction restriction unit restricts the direction of sheet discharge to the upward or downward direction with respect to the direction tangential to the nip part of the pair of fixing rollers.

Japanese Unexamined Patent Application Publication No. 2011-180230 describes an image forming apparatus including a fixing device. In the fixing device, a recording sheet carrying a transferred toner image and vertically transported to the fixing device is passed through a nip part formed between a heat rotator and a pressure rotator to fix the toner image to the recording sheet, and then the recording sheet with a fixed image is guided by a pair of guide members toward a discharge roller. With the fixing device viewed in cross-section perpendicular to the axis of the heat member, it is assumed that La denotes a straight line connecting the respective axial centers of the heat member and pressure member, Lb denotes a perpendicular line to the straight line La, P denotes a point on the contour of the guide surface of one of the pair of guide members that is located on the same side as the heat rotator, the point being a point on the contour located closest to the pressure rotator with respect to the direction parallel to the straight line La, Lc denotes a tangent line that, among tangent lines passing the point P and tangent to the outer periphery of the hear rotator, has a tangential point closer to the nip part, and D denotes the distance between the point P and the straight line La. In this case, the distance D is greater than or equal to 1.6 times and less than 2.4 times the diameter of the heat rotator, and the tangent line Lc is inclined toward the heat rotator relative to the perpendicular line Lb, the tangent line Lc forming an angle of greater than 2.2 degrees and less than 6.5 degrees with the perpendicular line Lb.

SUMMARY

Aspects of non-limiting embodiments of the present disclosure relate to an image forming apparatus that makes it possible to correct curl occurring at least in the leading end portion of a sheet leaving the nip part of a fixing unit, without provision of a driving source to the image forming apparatus.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including a fixing unit that transports a sheet of paper carrying an unfixed image through a nip part to fix the unfixed image to the sheet, the nip part applying heat and pressure to the sheet, a pair of transport rollers that first pinches and transports the sheet after the sheet leaves the nip part of the fixing unit, a first guide unit that guides transport of the sheet, the first guide unit coming into contact with a first side of the sheet at a position closer to the fixing unit than is the pair of transport rollers after the sheet leaves the nip part, and a second guide unit that guides transport of the sheet, the second guide unit coming into contact with a second side of the sheet at a position closer to the fixing unit than is the pair of transport rollers after the sheet leaves the nip part, the second side being opposite to the first side. The first guide unit has a recess serving as a guide part, the recess being recessed in a direction away from a transport path of the sheet. The second guide unit has a bending part serving as a guide part, the bending part having a shape of a circular arc in cross-section, the bending part being disposed such that at least a portion of the bending part lies inside the recess.

BRIEF DESCRIPTION OF THE DRAWINGS

Exemplary embodiments of the present disclosure will be described in detail based on the following figures, wherein.

DETAILED DESCRIPTION

Hereinafter, exemplary embodiments of the present disclosure will be described with reference to the drawings.

Exemplary Embodiment 1

Figure 1:
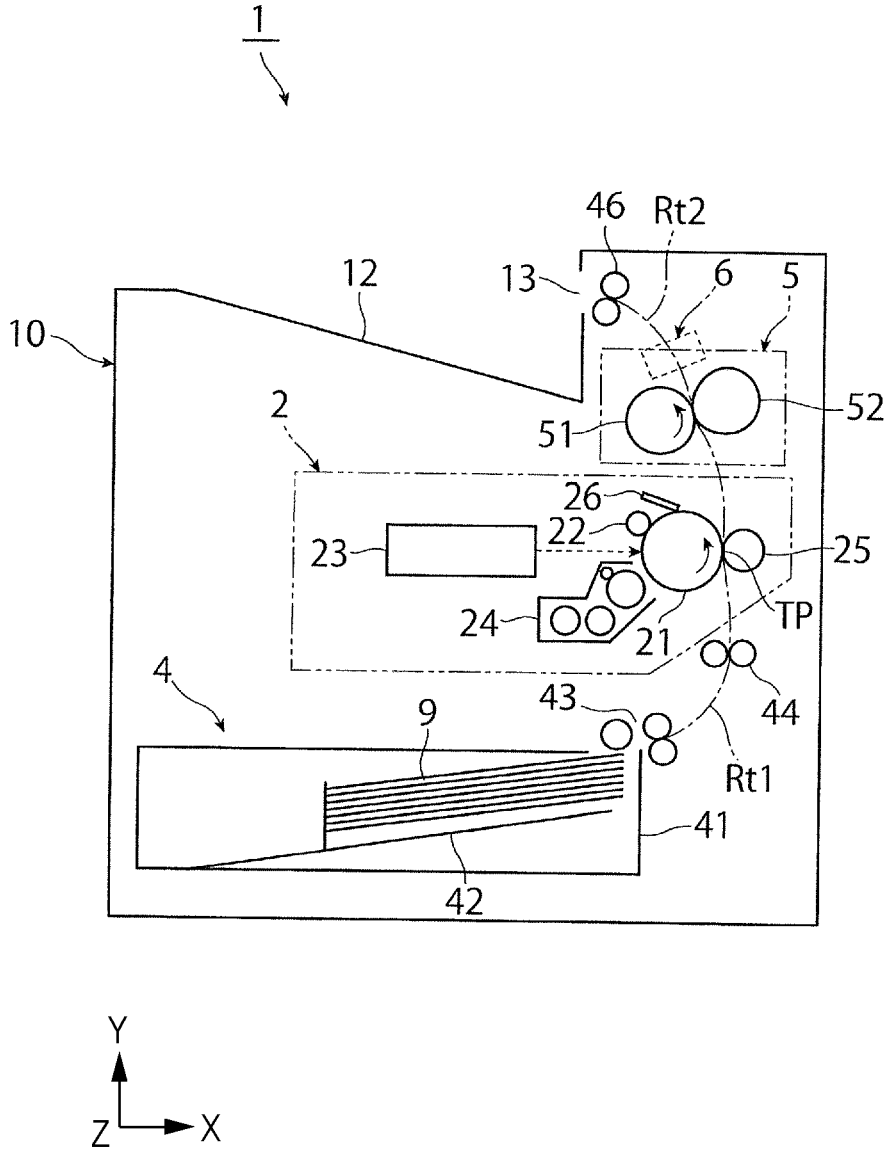
FIG. 1 schematically illustrates the general arrangement of an image forming apparatus according to Exemplary Embodiment 1.
Figure 2:
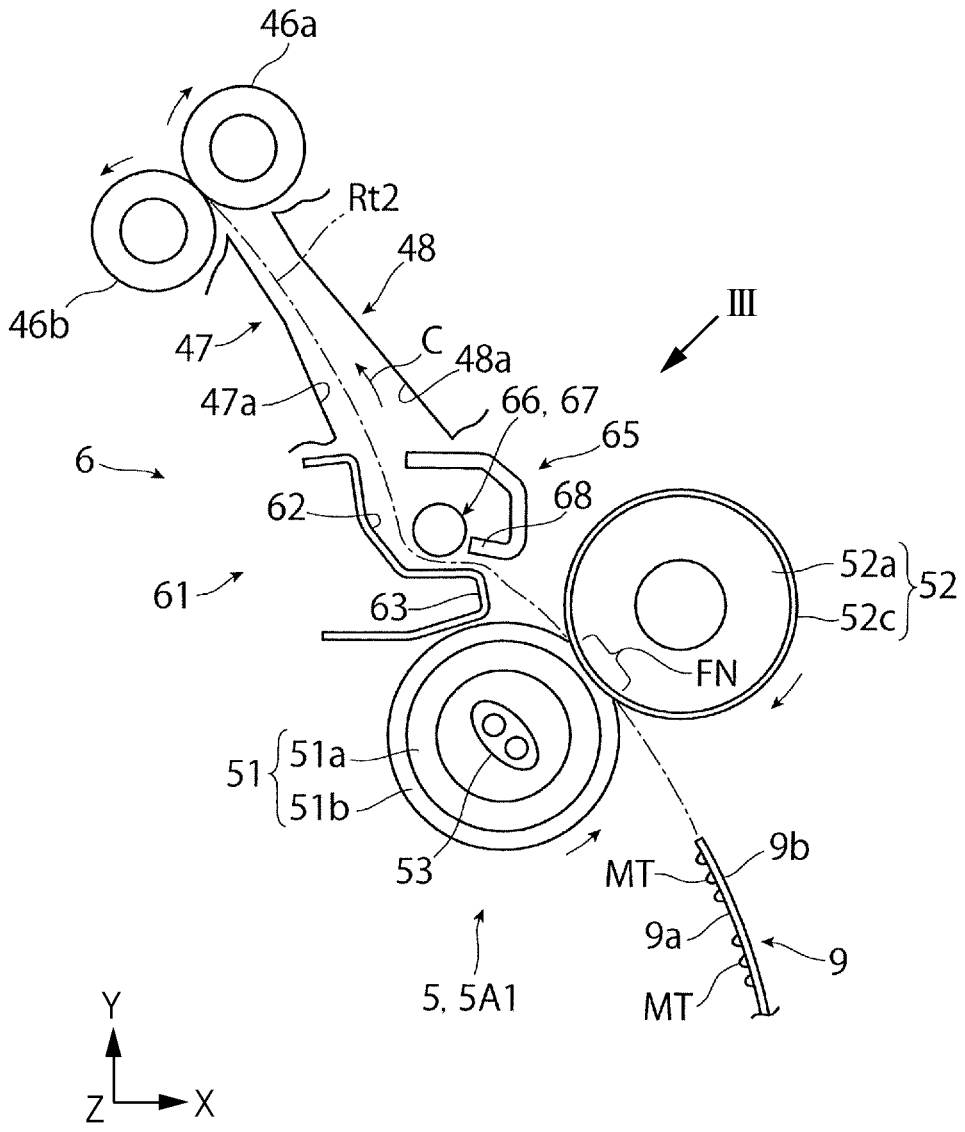
FIG. 2 schematically illustrates a portion (mostly a fixing part and a decurling part) of the image forming apparatus illustrated in FIG. 1.

FIGS. 1 and 2 illustrate an image forming apparatus 1 according to Exemplary Embodiment 1. FIG. 1 illustrates the configuration of the entire image forming apparatus 1, and FIG. 2 illustrates the configuration of a portion (mostly a fixing part and a decurling part) of the image forming apparatus 1.

Arrows denoted as X, Y, and Z in each figure respectively represent the width, height, and depth directions of a three-dimensional space assumed for the figure. In figures such as FIGS. 1 and 2, the hollow circle at the intersection of the X- and Y-direction arrows indicates that the Z-direction is oriented downward in the direction perpendicular to the plane of the figures.

Overall Configuration of Image Forming Apparatus

The image forming apparatus 1 is implemented as, for example, a printer that forms an image on a sheet 9 of paper based on externally input image information.

As illustrated in FIG. 1, the image forming apparatus 1 includes, for example, the following components disposed in the space inside a housing 10: an image forming part 2 that forms an unfixed image based on image information and transfers the unfixed image to the sheet 9; a paper feed part 4 that accommodates the sheet 9 to be supplied to the image forming part 2; a fixing part 5 that fixes, to the sheet 9, an unfixed image that has been transferred by the image forming part 2; and a decurling part 6 that corrects curl in the sheet 9 discharged from the fixing part 5. The alternate long and short dash line in FIG. 1 and other figures indicates a major transport path along which the sheet 9 is transported inside the housing 10.

Image information refers to information related to an image, such as a character, a geometric figure, a photograph, or a pattern. The housing 10 is a structure constructed of various types of support members, covering materials, or other components formed into a required shape. The housing 10 has, at a portion of its top surface, a paper output receiving part 12 in which each sheet 9 discharged after having an image formed thereon is received in a stacked manner, and a paper eject port 13 through which the sheet 9 is discharged toward the paper output receiving part 12.

In the image forming part 2, for example, the following devices related to an electrophotographic system are disposed around a photoconductor drum 21, which is an example of a photoconductor that rotates as indicated by the arrow.

Examples of the above-mentioned devices include a charging device 22, an exposure device 23, a developing device 24, a transfer device 25, and a cleaning device 26. The charging device 22 electrically charges the outer peripheral surface (surface on which an image can be formed) of the photoconductor drum 21. The exposure device 23 exposes the outer peripheral surface of the photoconductor drum 21 to light based on image information to thereby form an electrostatic latent image on the outer peripheral surface of the photoconductor drum 21. The developing device 24 develops an electrostatic latent image formed on the outer peripheral surface of the photoconductor drum 21 into a visible image by use of developer (toner). The transfer device 25 transfers an unfixed image (toner image) formed on the outer peripheral surface of the photoconductor drum 21 to the sheet 9. The cleaning device 26 cleans away unwanted substances such as toner or paper dust adhering to the outer peripheral surface of the photoconductor drum 21. In the image forming part 2, the area where the photoconductor drum 21 and the transfer device 25 contact or face each other serves as a transfer position TP through which the sheet 9 is passed to transfer an unfixed toner image to the sheet 9.

In the paper feed part 4, for example, devices such as an accommodating cassette 41 and a feeding device 43 are disposed. The paper feed part 4 is disposed at a positon inside the housing 10 below the image forming part 2.

Of the above-mentioned devices, the accommodating cassette 41, which has a loading plate 42 to receive a stack of multiple sheets 9 loaded in a required orientation, is an accommodating member that can be drawn out to the outside of the housing 10. The feeding device 43 pays out the stack of sheets 9 loaded on the loading plate 42 of the accommodating cassette 41 one by one, beginning with the uppermost sheet of the stack by means of multiple rollers or other components.

As illustrated in FIGS. 1 and 2, the fixing part 5 is a portion (fixing unit) of the image forming apparatus 1 where devices such as a heat rotator 51 and a pressure rotator 52 are disposed in the space inside a housing (not illustrated) having areas such as an entry and exit for the sheet 9. The fixing part 5 is disposed at a position inside the housing 10 above the transfer position TP of the image forming part 2.

Of the above-mentioned devices, the heat rotator 51 constitutes a portion of a fixing unit that is in the form of, for example, a roller that rotates as indicated by the arrow. The heat rotator 51 rotates as indicated by the arrow upon receiving rotational power from a driving device (not illustrated). Further, for example, the heat rotator 51 is heated by a heat source 53 disposed inside the heat rotator 51 such that the heat rotator 51 is kept at a required temperature. The pressure rotator 52 constitutes a portion of a fixing unit that is in the form of, for example, a roller that contacts the heat rotator 51 under a required applied pressure so as to rotate following the rotation of the heat rotator 51.

In the fixing part 5, the area where the heat rotator 51 and the pressure rotator 52 contact defines a nip part (fixing processing part) FN. In the nip part FN, the sheet 9 with a transferred unfixed toner image is subjected to heat and pressure for a fixing process.

The fixing part 5 discharges the sheet 9 from the nip part FN after a fixing process, in a substantially upward direction (e.g., in a direction (vertically upward direction) opposite to the direction of gravity and falling within a range of ±45 degrees to the direction of gravity). In the following description, the fixing part 5 that discharges a sheet in this manner will be sometimes also referred to as "upward discharge-type fixing part 5A".

As illustrated in FIG. 1, the image forming apparatus 1 includes a paper feed transport path Rt1 disposed between the paper feed part 4 and the image forming part 2 to feed and transport the sheet 9 accommodated in the paper feed part 4 to the transfer position TP of the image forming part 2. The paper feed transport path Rt1 is provided with components such as a pair of transport rollers 44 that pinches and transports the sheet 9, and a guide member (not illustrated) that provides a transport space for the sheet 9 to guide the transport of the sheet 9.

Further, a discharge transport path Rt2 is positioned between the fixing part 5 and the paper output receiving part 12 to transport the sheet 9 that has undergone a fixing process so that the sheet 9 is discharged to the paper output receiving part 12. The discharge transport path Rt2 is provided with components such as a pair of discharge rollers 46 and a guide member (not illustrated). The pair of discharge rollers 46 pinches and transports the sheet 9 at a position in front of the paper eject port 13, which is provided in a wall surface constituting a portion of the paper output receiving part 12 of the housing 10. The guide member provides a transport space for the sheet 9 to guide the transport of the sheet 9. The discharge transport path Rt2 defines a transport path that bends and extends upward from the fixing part 5 toward the pair of discharge rollers 46.

Image Forming Operation

The image forming apparatus 1 performs the following basic image forming operation.

First, when a controller (not illustrated) receives a command requesting for an image forming operation from an externally connected device or other devices, required portions of the image forming apparatus 1, such as those in the image forming part 2, the paper feed part 4, the fixing part 5, and other parts, activate at predetermined timing.

As illustrated in FIG. 1, in the image forming part 2, the photoconductor drum 21 starts to rotate in the direction indicated by the arrow. After the charging device 22 charges the outer peripheral surface of the photoconductor drum 21 to a required potential, the exposure device 23 irradiates the charged outer peripheral surface of the photoconductor drum 21 with light (indicated by the dashed arrow) corresponding to an image signal that has undergone image processing, thus forming an electrostatic latent image on the outer peripheral surface of the photoconductor drum 21. After this process, the developing device 24 supplies toner of a required color (e.g., black) serving as developer, so that the toner adheres to the electrostatic latent image through electrostatic action, thus developing the electrostatic latent image. A toner image of a required color corresponding to the electrostatic latent image is thus formed on the outer peripheral surface of the photoconductor drum 21.

Meanwhile, in the paper feed part 4, the sheet 9 accommodated in the accommodating cassette 41 is fed toward the transfer position TP of the image forming part 2 by the feeding device 43, in synchronization with the timing when an image forming operation is performed in the image forming part 2. At this time, the sheet 9 fed from the accommodating cassette 41 by the feeding device 43 of the paper feed part 4 is sent to the transport rollers 44, which are registration rollers, in the paper feed transport path Rt1. The sheet 9 is subsequently sent to the transfer position TP by the transport rollers 44 at required timing.

Then, at the transfer position TP of the image forming part 2, the transfer device 25 transfers a toner image formed on the photoconductor drum 21 to the sheet 9 fed from the paper feed part 4. Further, in the image forming part 2, the cleaning device 26 cleans away unnecessary substances that remain adhering to the outer peripheral surface of the photoconductor drum 21 after, for example, the transfer process.

Subsequently, the sheet 9 having the toner image transferred thereto in the image forming part 2 is discharged from the transfer position TP toward the fixing part 5. In the fixing part 5, the sheet 9 carrying the toner image is advanced through the nip part FN. Thus, in the nip part FN, the toner image on the sheet 9 is heated under applied pressure to melt, and then fixed to the sheet 9.

Lastly, after the fixing process, the sheet 9 is discharged from the fixing part 5. The sheet 9 is then transported via the discharge transport path Rt2 to the paper output receiving part 12 so that the sheet 9 is received in the paper output receiving part 12. At this time, after undergoing the fixing process and leaving the fixing part 5, the sheet 9 is transported to the discharge rollers 46 via the discharge transport path Rt2. The sheet 9 is then sent by the discharge rollers 46 to the outside of the housing 10 through the paper eject port 13, such that the sheet 9 is dropped to the paper output receiving part 12 and received in the paper output receiving part 12.

Through the series of processes mentioned above, an image of a required color is formed on one side of a single sheet 9, thus completing the basic image forming operation.

If the image forming apparatus 1 receives a command issued to request for an image forming operation on multiple sheets 9, the above-mentioned series of processes is repeated in the same manner for a number of times corresponding to the number of such sheets.

Curl Generated During Fixing Process

Figure 17A:
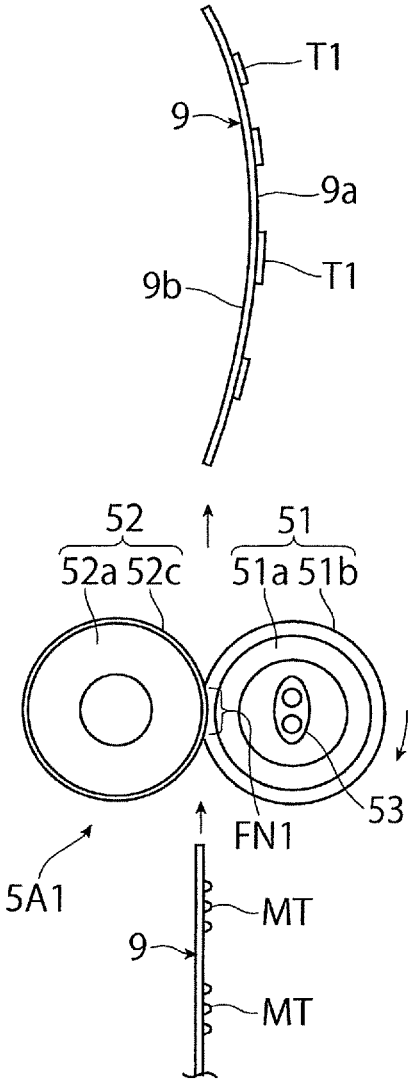
FIG. 17A schematically illustrates a fixing part with type-1 nip, and a sheet leaving the fixing part and having away-from-image curl.

As illustrated in FIG. 17A, in the image forming apparatus 1 described above, the sheet 9 may sometimes develop a curl described below after leaving the nip part FN of the fixing part (fixing unit) 5. The curl generated at this time (also called, for example, "away-from-image curl") results from deformation of the sheet 9 into a curved shape such that the sheet 9 warps toward a back side 9*b* opposite to a front side 9*a* carrying an image T1, which represents an image formed immediately after fixing of an unfixed image (toner image) MT.

This curl tends to occur, for example, when the following conditions exist: the fixing part 5 is implemented as a fixing unit having a nip part FN1 where the pressure rotator 52 bites into the surface of the heat rotator 51; and a plain paper sheet is used as the sheet 9.

As illustrated in FIG. 2 or 17A, the fixing part 5 according to Exemplary Embodiment 1 is a fixing part having the following configuration (e.g., the fixing part 5 with type-1 nip). That is, the fixing part 5 includes the heat rotator 51 having at least an elastic layer 51*b* disposed on the outer peripheral surface of a roller base 51*a* made of metal or other materials, and the pressure rotator 52 having a release layer 52*c* disposed on a roller base 52*a* made of metal or other materials. The heat rotator 51 and the pressure rotator 52 are used to form the nip part FN1 where the pressure rotator 52 bites into the elastic layer 51*b* of the heat rotator 51 and the elastic layer 51*b* becomes recessed as a result.

The fixing part 5 is the upward discharge-type fixing part 5A and is also the fixing part 5 with type-1 nip. Accordingly, the fixing part 5 will be hereinafter sometimes referred to as upward discharge-type fixing part 5A1 with type-1 nip. The term plain paper sheet as used herein refers to a sheet of paper that is neither thin paper nor heavy paper, with a basis weight in the range of, for example, 60 to 105 g/m$^2$.

If the upward discharge-type fixing part 5A1 with type-1 nip is used to perform a fixing process with a heavy paper sheet (e.g., a sheet of paper with a basis weight of 106 g/m$^2$ or more) used as the sheet 9, the away-from-image curl mentioned above does not occur in the heavy paper sheet. In this case, the heavy paper sheet may sometimes develop a curl (also called, for example, "toward-image curl") such that the heavy paper sheet is deformed so as to curve toward the side carrying an image formed immediately after fixing of an unfixed image.

Figure 17B:
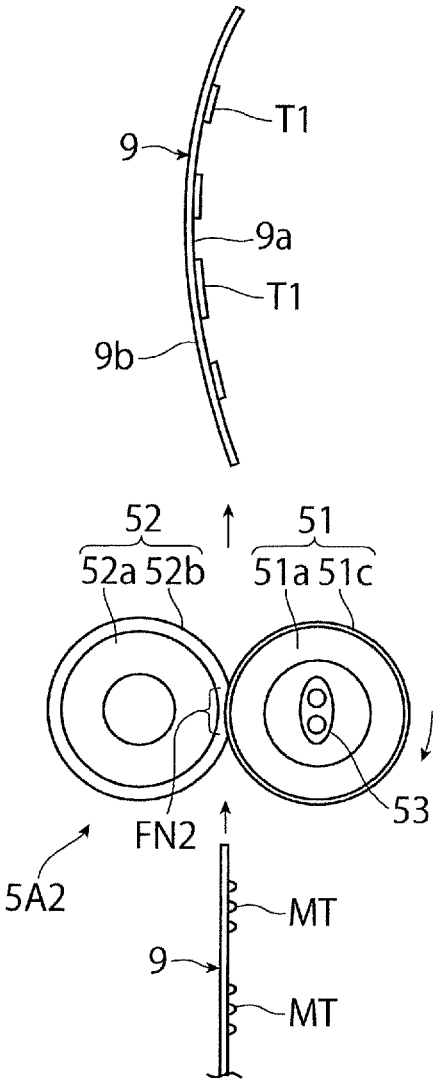
FIG. 17B schematically illustrates a fixing part with type-2 nip, and a sheet leaving the fixing part and having toward-image curl.

In this regard, as illustrated in FIG. 17B, the toward-image curl mentioned above tends to form also when, for example, the following conditions exist: the fixing part 5 is implemented as a fixing unit having a nip part FN2 where the heat rotator 51 bites into the surface of the pressure rotator 52; and a plain paper sheet is used as the sheet 9.

Figure 15:
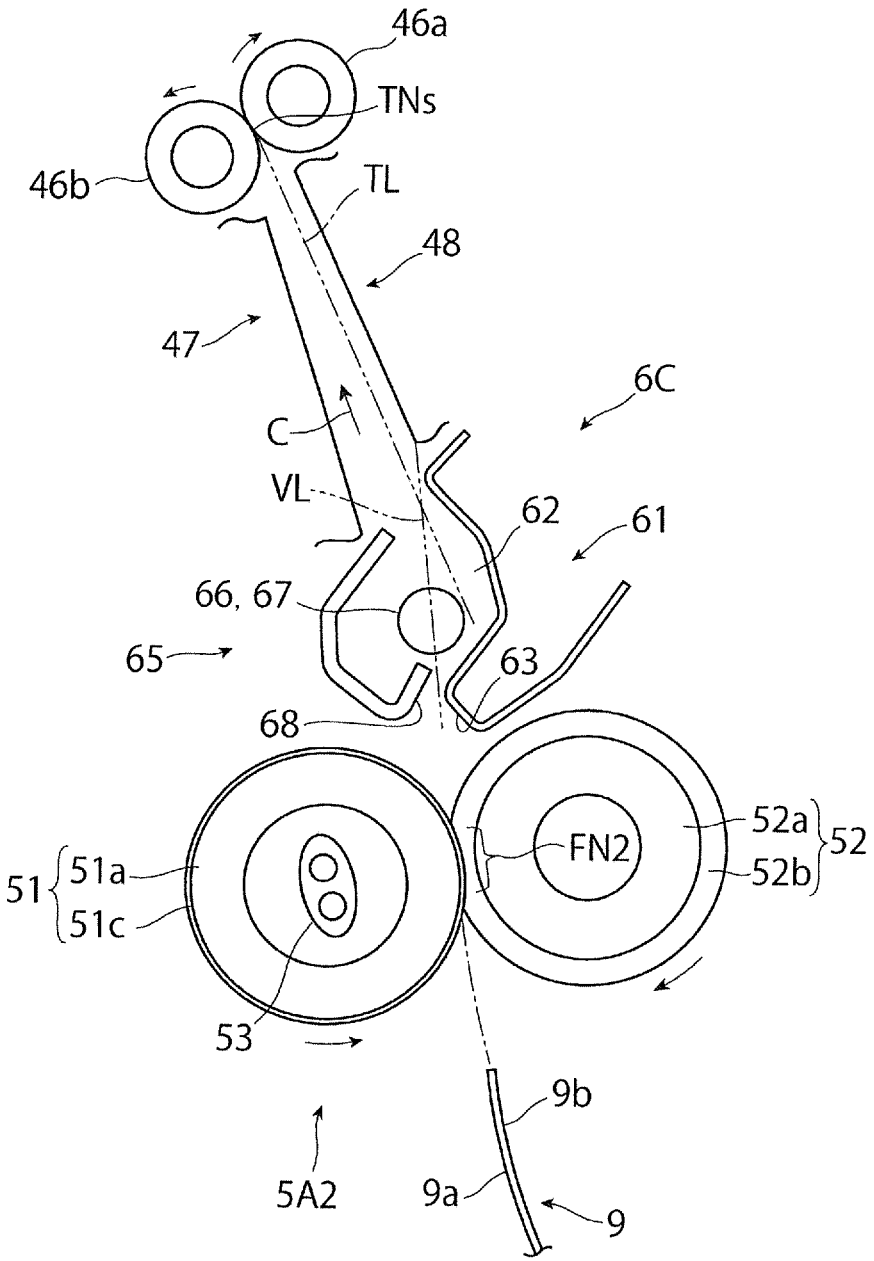
FIG. 15 schematically illustrates another exemplary configuration of a fixing part and a decurling part.

As illustrated in FIG. 15 or 17B, the fixing part 5 in this case is a fixing part having the following configuration (e.g., the fixing part 5 with type-2 nip). That is, the fixing part 5 includes the heat rotator 51 having a release layer 51*c* disposed on the outer peripheral surface of the roller base 51*a* made of metal or other materials, and the pressure rotator 52 having an elastic layer 52*b* disposed on the roller base 52*a* made of metal or other materials. The heat rotator 51 and the pressure rotator 52 are used to form the nip part FN2 where the heat rotator 51 bites into the elastic layer 52*b* of the pressure rotator 52 and the elastic layer 52*b* becomes recessed as a result. The fixing part 5 is the upward discharge-type fixing part 5A and is also the fixing part 5 with type-2 nip. Accordingly, the fixing part 5 will be hereinafter sometimes referred to as upward discharge-type fixing part 5A2 with type-2 nip.

If the upward discharge-type fixing part 5A2 with type-2 nip is used to perform a fixing process with a heavy paper sheet used as the sheet 9, the heavy paper sheet may sometimes develop the toward-image curl mentioned above, although the degree of curvature occurring in the sheet 9 in this case is not as great as the degree of curvature that would occur in a plain paper sheet.

Detailed Configuration of Image Forming Apparatus (Decurling Part)

To address the above-mentioned curling, the image forming apparatus 1 includes the decurling part (decurling device) 6 having the configuration described below.

Figure 3:
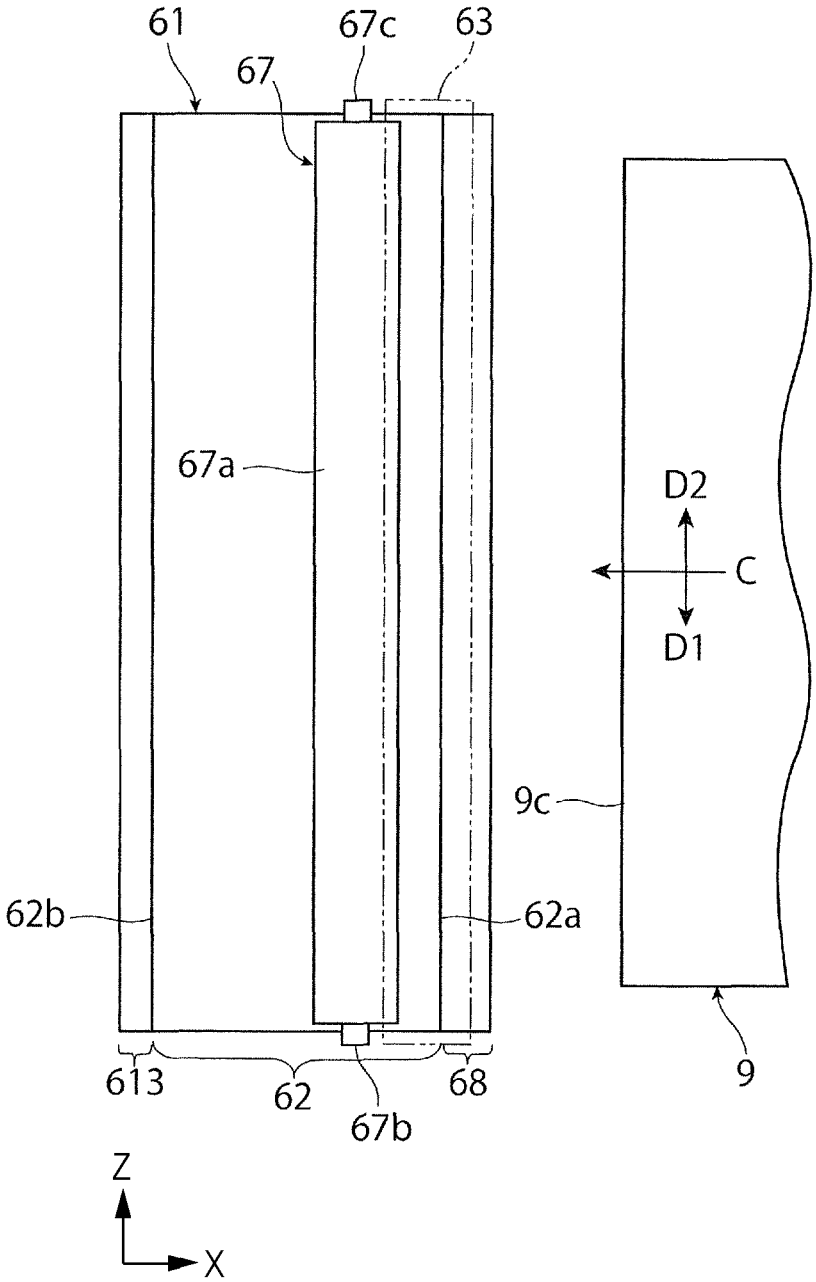
FIG. 3 schematically illustrates the decurling part illustrated in FIG. 2 as viewed in a direction indicated by an arrow III in FIG. 2, except for a portion of a second guide unit.
Figure 4:
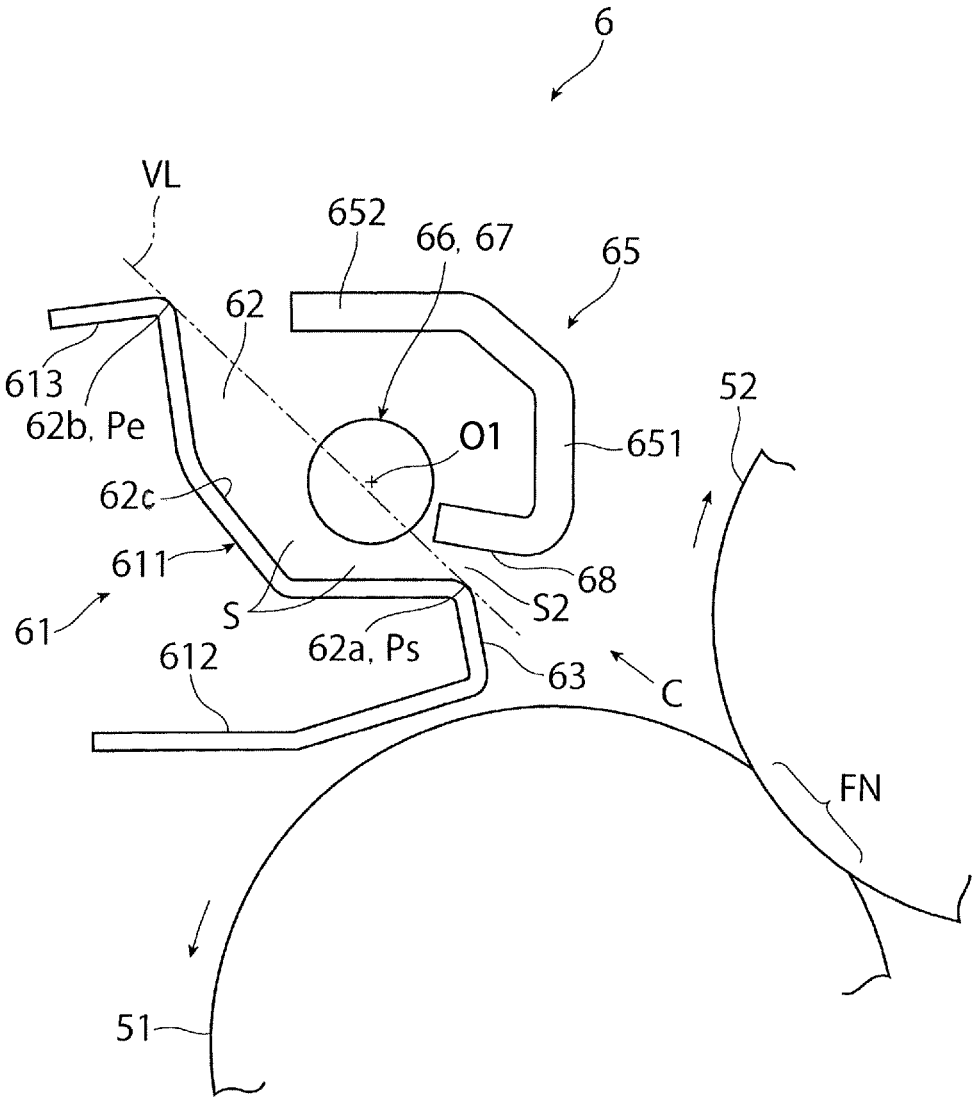
FIG. 4 schematically illustrates, in enlarged view, a configuration of the decurling part illustrated in FIG. 2.

As illustrated in FIGS. 2 to 4 or other figures, the decurling part 6 includes the discharge rollers 46, a first guide unit 61, and a second guide unit 65. The discharge rollers 46 represent an example of a pair of transport rollers that first pinches and transports the sheet after the sheet leaves the nip part FN of the fixing part 5. The first guide unit 61 guides the transport of the sheet 9. The first guide unit 61 comes into contact with the front side 9*a* of the sheet 9 at a position closer to the fixing part 5 than is the pair of discharge rollers 46 after the sheet 9 leaves the nip part FN. The second guide unit 65 guides the transport of the sheet 9. The second guide unit 65 comes into contact with the back side 9*b* opposite to the front side 9*a* of the sheet 9 at a position closer to the fixing part 5 than is the pair of discharge rollers 46 after the sheet 9 leaves the nip part FN.

The front side 9*a* of the sheet 9 refers to one side of the sheet 9 toward which the sheet 9 is bent for decurling. The back side 9*b* of the sheet 9 refers to the side opposite to the front side 9*a* and toward which a curl to be corrected is curved. When viewed from the fixing part 5, with respect to the nip part FN, the first guide unit 61 is disposed to lie on the same side as the heat rotator 51. By contrast, the second guide unit 65 is disposed to lie on the same side as the pressure rotator 52 relative to the first guide unit 61.

As illustrated in FIG. 2 or 4, the first guide unit 61 of the decurling part 6 has a recess 62 that serves as a guide part to guide the sheet 9. The recess 62 is recessed in a direction away from the transport path of the sheet 9 (the path indicated by the alternate long and short dash line).

Further, as illustrated in FIG. 2 or 4, the second guide unit 65 of the decurling part 6 has a bending part 66 that serves as a guide part to guide the sheet 9. The bending part 66 has the shape of a circular arc in cross-section along a transport direction C of the sheet 9. Moreover, the bending part 66 of the second guide unit 65 of the decurling part 6 is disposed such that at least a portion of the bending part 66 lies inside the recess 62 of the first guide unit 61.

As illustrated in FIGS. 2 to 4, the first guide unit 61 is a plate-shaped member 611 extending continuously over the entire area in a width direction D1-D2 of the sheet 9 that intersects the transport direction C of the sheet 9 at substantially right angles. The first guide unit 61 is disposed facing the heat rotator 51 along the axis thereof, at a position displaced downstream from the nip part FN of the fixing part 5 with respect to the rotational direction of the heat rotator 51.

The recess 62 serving as a guide part of the first guide unit 61 is located substantially in the middle of the member 611 with respect to the transport direction C of the sheet 9. The recess 62 is in the form of an elongated groove curved along the transport direction C of the sheet 9 and extending in the width direction D1-D2 of the sheet 9.

Features of the recess 62 such as its depth as well as its length and shape with respect to the transport direction C of the sheet 9 are set in accordance with, for example, the amount of bending applied to the sheet 9 to decurl the sheet 9.

As illustrated in FIG. 4 or FIGS. 6A to 6D, the recess 62 represents the area bounded by a straight line (or plane) VL connecting a vertex Ps and a vertex Pe, and a recessed guide surface 62*c* that guides the sheet 9. The vertex Ps is the vertex of the most upstream projection (an upstream end portion 62*a* of the recess 62) with respect to the transport direction C of the sheet 9 among projections of the guide part of the first guide unit 61 that project toward the transport path of the sheet 9. The vertex Pe is the vertex of the most downstream projection (a downstream end portion 62*b* of the recess 62) with respect to the transport direction C of the sheet 9 among the above-mentioned projections.

Figure 6A:
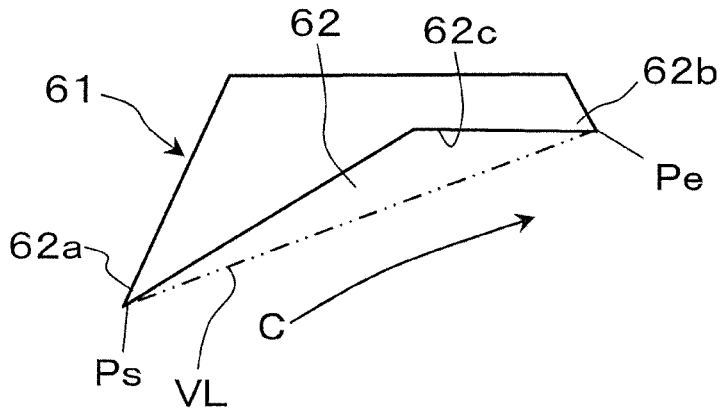
FIGS. 6A to 6D each schematically illustrate another exemplary configuration of a recess of a first guide unit of a decurling part.
Figure 6B:
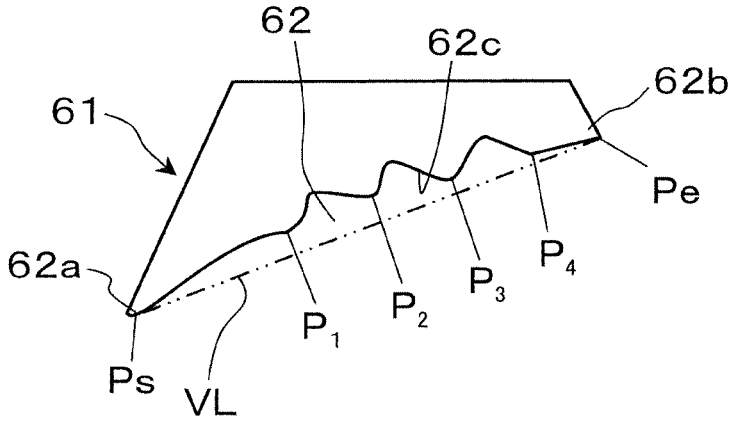
Figure 6C:
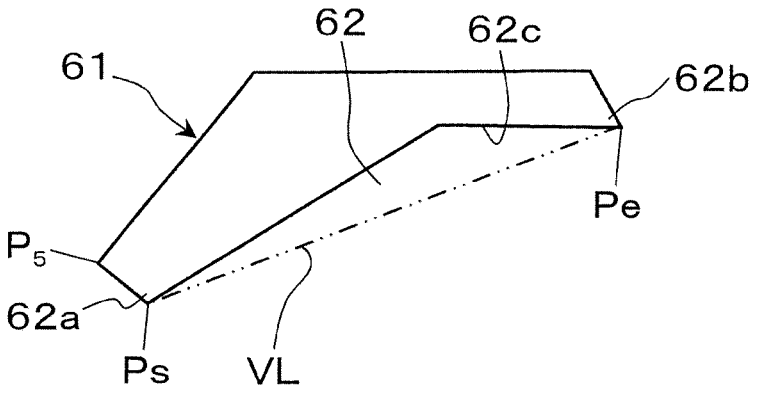
Figure 6D:
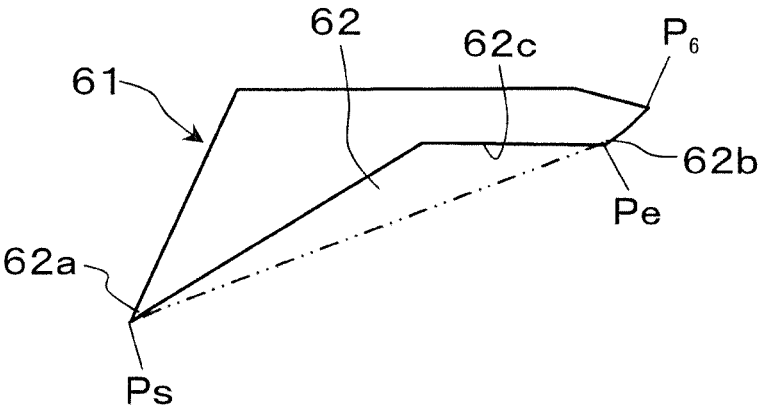

If the guide surface 62*c* of the recess 62 has intermediate projections in the intermediate area between the upstream end portion 62*a* and the downstream end portion 62*b* of the recess 62 as illustrated in FIG. 6B, none of the vertices $P_1$ to $P_4$ of such intermediate projections corresponds to vertices connected by the straight line VL. Likewise, neither a vertex $P_5$ nor a vertex $P_6$ described below corresponds to vertices connected by the straight line VL. The vertex $P_5$ is the vertex of a projection (corner) located upstream of the upstream end portion 62*a* of the recess 62 with respect to the transport direction C of the sheet 9 as illustrated in FIG. 6C. The vertex $P_6$ is the vertex of a projection (corner) located downstream of the downstream end portion 62*b* of the recess 62 with respect to the transport direction C of the sheet 9 as illustrated in FIG. 6D.

As illustrated in FIG. 2 or 4, the first guide unit 61 also has a directing part 63 serving as a guide part. The directing part 63 is disposed at the upstream end portion 62*a* of the recess 62 of the plate-shaped member 611 with respect to the transport direction C of the sheet 9 to direct a leading end 9*c* of the sheet 9 into contact with a lead-in part 68 of the second guide unit 65. The lead-in part 68 will be described later.

The directing part 63 has, for example, a surface that extends from the upstream end portion 62*a* of the recess 62 in a direction substantially normal to the heat rotator 51. The imaginary extension of the surface intersects a portion of the lead-in part 68 located near the bending part 66.

Figure 5:
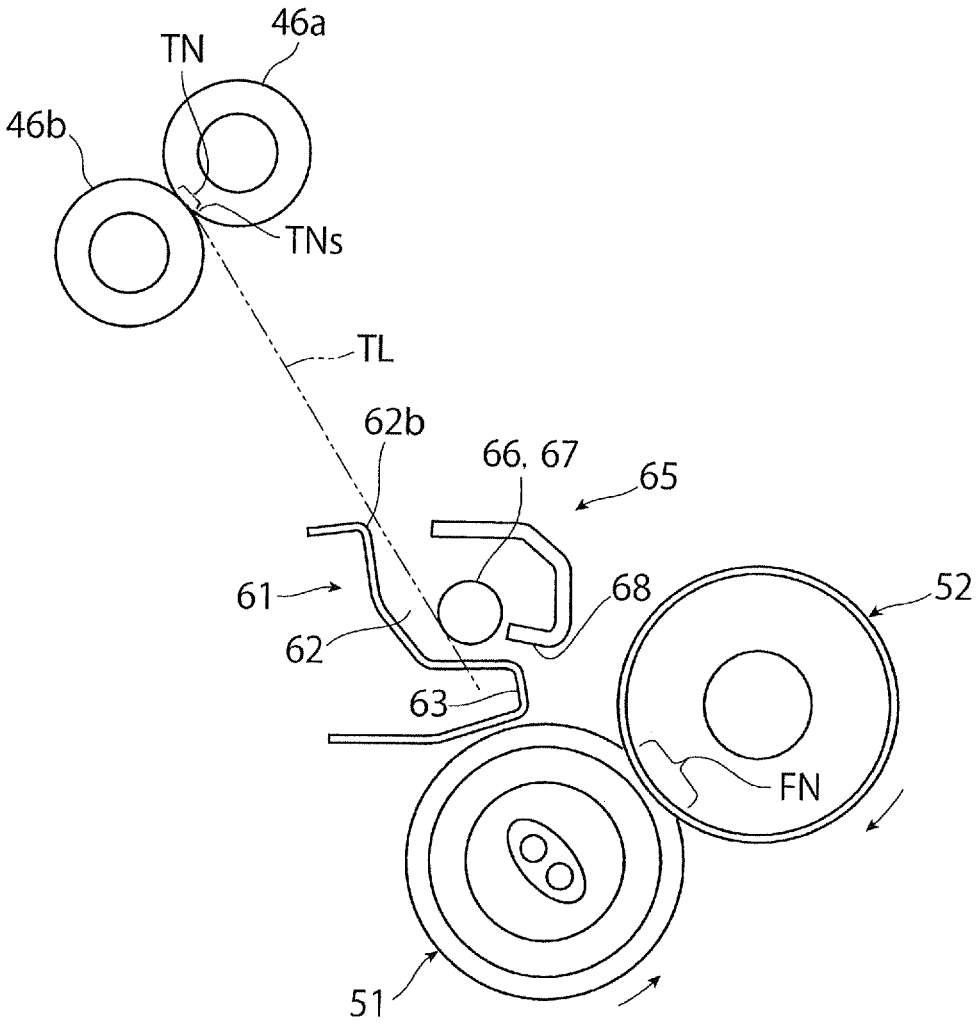
FIG. 5 schematically illustrates another configuration of a decurling part.

Further, as illustrated in FIG. 5, the downstream end portion 62*b* of the recess 62 of the first guide unit 61 is positioned in a direction away from the transport path of the sheet 9 relative to a tangent line TL. The tangent line TL is tangent to the bending part 66 of the second guide unit 65 and to the entrance TNs of a nip part TN formed by the pair of discharge rollers 46.

The tangent line TL may be, for example, a line tangent to a driven discharge roller 46*b* and to the bending part 66 (a roller 67). The driven discharge roller 46*b* is one of the pair of discharge rollers 46 located on the opposite side to the bending part 66 across the transport path of the sheet 9.

From the viewpoint of reducing contamination resulting from contact with the sheet 9 (including a fixed image) after a fixing process, the first guide unit 61 may have a release layer made of fluorocarbon resin or other materials disposed on at least the guide surface 62*c* of the recess 62 and the surface of the directing part 63.

As illustrated in FIG. 4, the first guide unit 61 has a first extension 612 and a second extension 613. The first extension 612 extends in the direction of rotation of the heat rotator 51 from an end portion of the directing part 63 facing the heat rotator 51. The second extension 613 extends from the downstream end portion 62*b* of the recess 62 in substantially the same direction as the direction in which the recess 62 is recessed. The first extension 612 and the second extension 613, which are an appendage and an attachment provided for the purpose of forming the recess 62, the directing part 63, or other parts, may not be provided in some cases.

The second guide unit 65 is disposed such that at least a portion of the bending part 66 lies inside the recess 62 of the first guide unit 61. More specifically, as illustrated in FIG. 4, a portion of the bending part 66 lies within the area of the recess 62, beyond the straight line VL connecting the vertex Ps of the upstream end portion 62*a* of the recess 62 and the vertex Pe of the downstream end portion 62*b* of the recess 62.

The bending part 66 is disposed facing the recess 62 of the first guide unit 61, with a required spacing S provided between the bending part 66 and the recess 62 to allow passage of the sheet 9. The spacing S may be adjusted by, for example, changing the amount of entry of the bending part 66 into the recess 62, the shape or depth of the recess 62, or other conditions.

As illustrated in FIGS. 2 to 4, the bending part 66 is positioned offset toward the downstream portion of the recess 62 of the first guide unit 61 with respect to the transport direction C of the sheet 9. That is, the relationship between the bending part 66 and the recess 62 at this time is such that the separation (gap) between the bending part 66 and the upstream end portion 62*a* of the recess 62 is less than the separation between the bending part 66 and the downstream end portion 62*b* of the recess 62.

The bending part 66 according to Exemplary Embodiment 1 is implemented as, for example, the roller 67, which is an example of a rotator disposed in a rotatable manner and having a circular cross-section.

As illustrated in FIG. 3, shaft portions 67*b* and 67*c* of the roller 67 of the bending part 66, which are located at the ends of a body portion 67*a* having the shape of a circular column or circular cylinder, are rotatably mounted and supported on a support member (not illustrated). The roller 67 is formed as a rigid body that is not subject to elastic deformation. As illustrated in FIG. 4, the roller 67 of the bending part 66 is disposed such that its center of rotation O1 does not lie inside the recess 62 of the first guide unit 61. That is, at this time, a portion of the semi-cylindrical portion of the roller 67 lies inside the recess 62.

As illustrated in FIGS. 2 to 4 or other figures, the second guide unit 65 also has the lead-in part 68 serving as a guide part. The lead-in part 68 is disposed upstream of the bending part 66 with respect to the transport direction C of the sheet 9 to guide the sheet 9 to the bending part 66.

As illustrated in FIG. 4, for example, the lead-in part 68 has a surface that extends toward the bending part 66 from a position located downstream of the directing part 63 of the first guide unit 61 with respect to the rotational direction of the heat rotator 51. The above-mentioned surface faces the directing part 63 of the first guide unit 61 and the upstream end portion 62*a* of the recess 62 with a required spacing S2 therefrom that allows passage of the sheet 9.

The lead-in part 68 is disposed so as to define, together with the directing part 63 of the first guide unit 61, a receiver opening facing the nip part FN of the fixing part 5 and through which the sheet 9 leaving the nip part FN is led into the decurling part 6. In actuality, the receiver opening is formed as an opening that defines, between the lead-in part 68 and the directing part 63 that face each other, a gap that gradually decreases in width as the gap extends downstream with respect to the transport direction C of the sheet 9.

Further, as illustrated in FIG. 4, the lead-in part 68 is disposed such that the lead-in part 68 does not lie inside the recess 62 of the first guide unit 61. That is, no portion of the lead-in part 68 extends into the recess 62 beyond the straight line VL connecting the vertex Ps of the upstream end portion 62*a* and the vertex Pe of the downstream end portion 62*b* of the recess 62.

Further, as illustrated in FIG. 4, the second guide unit 65 has extensions 651 and 652. The extensions 651 and 652 extend from an end portion of the lead-in part 68 opposite from the bending part 66 so as to face the recess 62 of the first guide unit 61 and cover the bending part 66 (the roller 67). The extensions 651 and 652, which are an appendage and an attachment provided for the purpose of forming the lead-in part 68, may not be provided in some cases.

Although the decurling part 6 has been described above as being separate from the fixing part 5, the decurling part 6 may be implemented as a device or mechanism incorporated into the fixing part 5 as a portion of the fixing part 5.

As illustrated in FIG. 2 or other figures, in the decurling part 6, the first guide unit 61, the second guide unit 65, and the bending part 66 constitute the transport passage (space) of the discharge transport path Rt2 together with discharge guide units 47 and 48, which are disposed between each of the first guide unit 61 and the second guide unit 65 and the pair of discharge rollers 46 to guide discharge of the sheet 9.

Each of the discharge guide units 47 and 48 is implemented as a dedicated guide member, or as a guide part that also serves as a portion of another support member.

Of the two discharge guide units, the discharge guide unit 47 is disposed with a lower guide part 47*a* located between the first guide unit 61 of the decurling part 6 and one (e.g., the driven discharge roller 46*b*) of the pair of discharge rollers 46. The discharge guide unit 48 is disposed with an upper guide part 48*a* located between the second guide unit 65 of the decurling part 6 and the other one (e.g., a driving discharge roller 46*a*) of the pair of discharge rollers 46.

Operation of Decurling Part

Hereinafter, operation of the decurling part 6 will be described.

Now, the operation of the decurling part 6 when a plain paper sheet 9A is used as the sheet 9 will be described.

Figure 7:
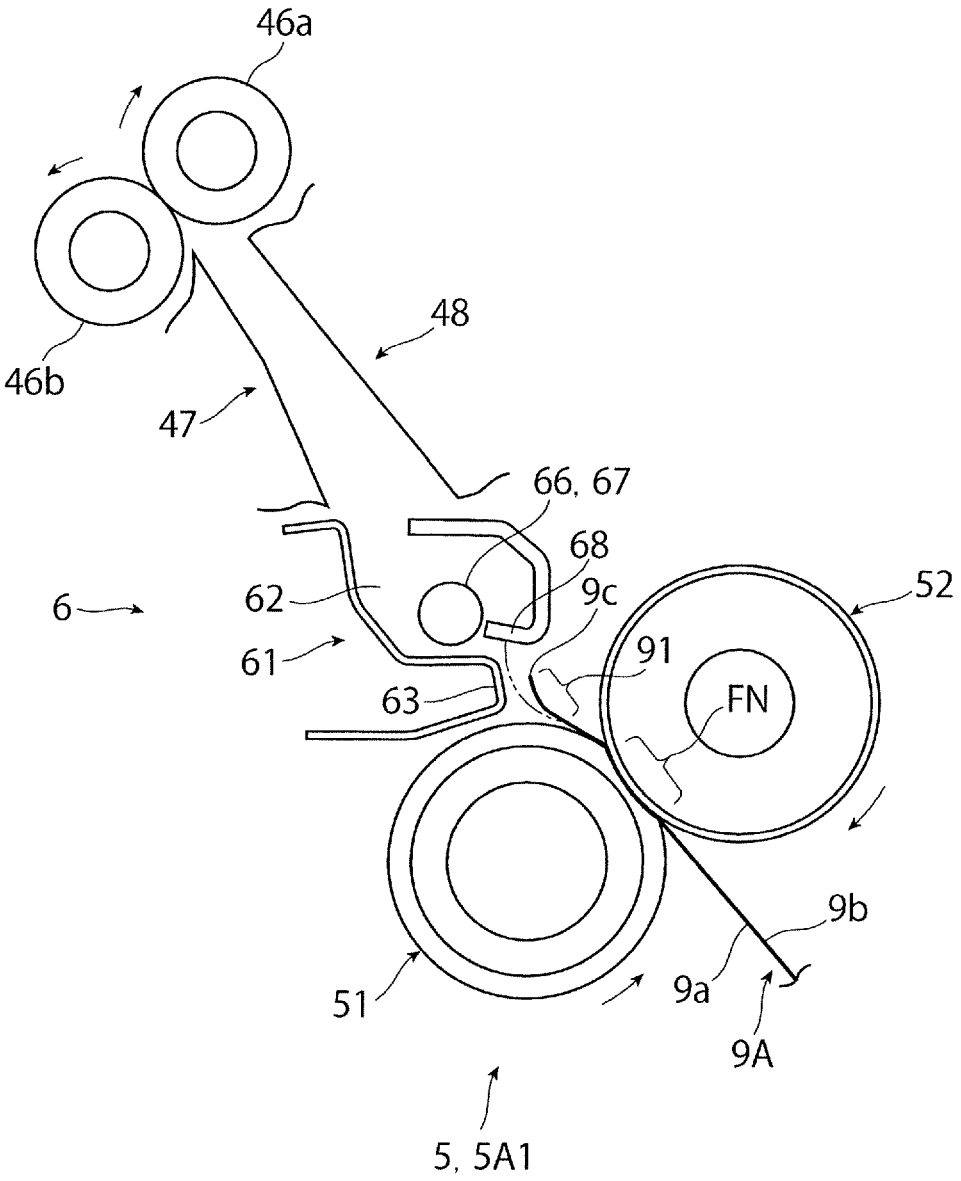
FIG. 7 schematically illustrates an operational state when a curled plain paper sheet leaving a fixing part is led into a decurling part.

In this case, in the fixing process, the plain paper sheet 9A is discharged from the nip part FN of the fixing part 5 as illustrated in FIG. 7 and then travels to the decurling part 6.

As described above, the fixing part 5 in this case is the upward discharge-type fixing part 5A1 with type-1 nip as illustrated in FIG. 17A. Accordingly, in the fixing part 5A1, the plain paper sheet 9A carrying a transferred unfixed image passes through the nip part FN (FN1) formed by the heat rotator 51 rotating as indicated by the arrow and the pressure rotator 52 that is in pressure contact with the heat rotator 51 while biting into the surface (elastic layer 51*b*) of the heat rotator 51. The plain paper sheet 9A is then naturally stripped from the heat rotator 51, and discharged substantially upward.

As illustrated in FIG. 7, as the plain paper sheet 9A is transported after leaving the nip part FN of the fixing part 5A1, the plain paper sheet 9A sometimes develops an away-from-image curl 91. The away-from-image curl 91 occurs as the plain paper sheet 9A is deformed into a curved shape that warps toward the back side 9*b* opposite to the front side 9*a* carrying the transferred unfixed image.

Subsequently, the plain paper sheet 9A having the away-from-image curl continues its travel under the transport force provided by the nip part FN1 of the fixing part 5A1. After the leading end 9*c* of the plain paper sheet 9A comes into contact with, for example, the directing part 63 of the first guide unit 61 in the decurling part 6, the leading end 9*c* of the plain paper sheet 9A is directed into contact with the lead-in part 68 of the second guide unit 65 in the decurling part 6 as indicated by the two-dot chain line in FIG. 7.

At this time, the leading end 9*c* of the plain paper sheet 9A may sometimes come into contact with the lead-in part 68 of the second guide unit 65 first before coming into contact with the directing part 63 of the first guide unit 61.

Figure 8:
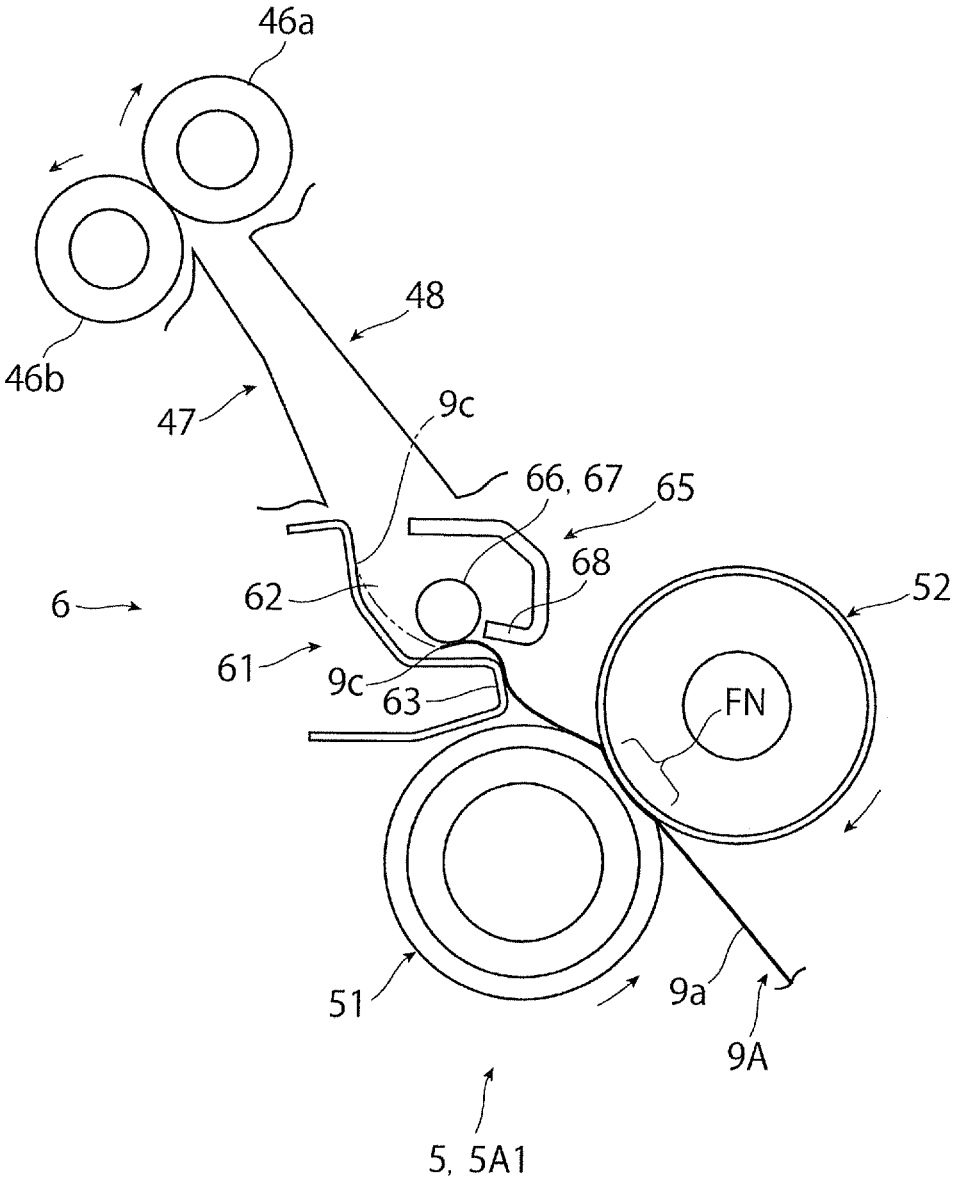
FIG. 8 schematically illustrates an operational state when decurling is applied to a curled plain paper sheet in a decurling part.

In the decurling part 6, as illustrated in FIG. 8, the leading end portion of the plain paper sheet 9A having away-from-image curl is guided by the lead-in part 68 of the second guide unit 65 such that the leading end portion of the plain paper sheet 9A is led into the gap between the recess 62 of the first guide unit 61 and the roller 67 serving as the bending part 66 of the second guide unit 65.

At this time, as indicated by the solid line in FIG. 8, the plain paper sheet 9A with the away-from-image curl is transported with its leading end portion being bent so as to warp toward the front side 9*a* carrying the transferred unfixed image. Further, as indicated by the two-dot chain line in FIG. 8, after passing the roller 67 serving as the bending part 66 of the second guide unit 65, the leading end 9*c* of the plain paper sheet 9A travels such that the leading end 9*c* of the plain paper sheet 9A is brought into contact with and guided by the guide surface 62*c* of the recess 62 of the first guide unit 61.

Subsequently, as indicated by the solid line in FIG. 9, after passing the recess 62 of the first guide unit 61 of the decurling part 6, the leading end 9*c* of the plain paper sheet 9A travels such that the leading end 9*c* of the plain paper sheet 9A is led into the transport passage defined by the discharge guide units 47 and 48. Thereafter, as indicated by the two-dot chain line with an arrow in FIG. 9, the leading end 9*c* of the plain paper sheet 9A passes through the transport passage between the discharge guide units 47 and 48, either by simply moving through the transport passage or while being guided by the discharge guide units 47 and 48. The leading end 9*c* of the plain paper sheet 9A is then transported so as to reach the pair of discharge rollers 46 (the nip part TN formed by pressure contact between the driving discharge roller 46*a* and the driven discharge roller 46*b*) rotating as indicated by the arrows.

At this time, even at the point when the leading end portion of the plain paper sheet 9A becomes pinched by the pair of discharge rollers 46 during its transport, the trailing portion of the plain paper sheet 9A moving through the decurling part 6 is reliably bent so as to warp toward the front side 9*a* when passing between the recess 62 of the first guide unit 61 and the roller 67 serving as the bending part 66 of the second guide unit 65. At this time, as illustrated in FIG. 9, as the back side 9*b* of the plain paper sheet 9A moves while contacting the roller 67 serving as the bending part 66 of the second guide unit 65, the roller 67 rotates as indicated by the arrow following this movement.

Figure 10:
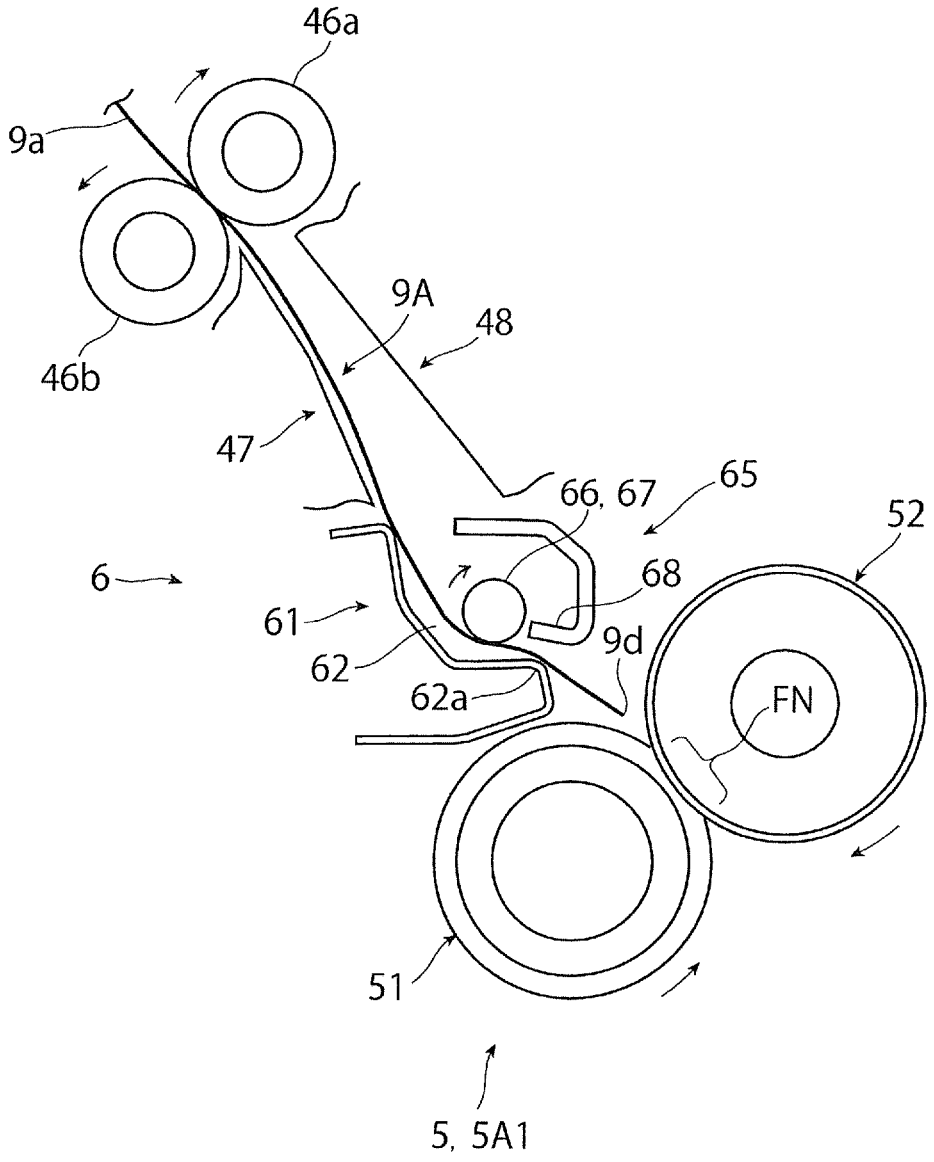
FIG. 10 schematically illustrates still another operational state when decurling is applied to a curled plain paper sheet in a decurling part.

Further, as illustrated in FIG. 10, even at the point when a trailing end 9*d* of the plain paper sheet 9A passes through the nip part FN of the fixing part 5 during its transport, the trailing end portion of the plain paper sheet 9A is bent to some degree so as to warp toward the front side 9*a* during its passage through the gap between the recess 62 of the first guide unit 61 and the roller 67 serving as the bending part 66 of the second guide unit 65.

As described above, for the plain paper sheet 9A leaving the nip part FN of the fixing part 5 (5A1) and having away-from-image curl, the decurling part 6 applies the following action to not only the leading end portion but also the trailing portion of the plain paper sheet 9A. That is, as the plain paper sheet 9A is passed through the gap between the recess 62 of the first guide unit 61 and the roller 67 serving as the bending part 66 of the second guide unit 65, the decurling part 6 temporarily bends the plain paper sheet 9A into a curved shape that warps toward the front side 9*a*. This corrects the away-from-image curl in the plain paper sheet 9A such that the away-from-image curl substantially disappears over the area of the plain paper sheet 9A from its leading end portion to the trailing portion.

At this time, the away-from-image curl is corrected in the decurling part 6 mostly by the recess 62 of the first guide unit 61 and the roller 67 serving as the bending part 66 of the second guide unit 65. Thus, the correction of the away-from-image curl does not require an operation such as adjusting the position of the first guide unit 61 by means of a driving source or rotating the roller 67 by means of a driving source. Therefore, the away-from-image curl is corrected by means of a relatively simple structure without requiring a driving source.

Further, with the image forming apparatus 1, even when the plain paper sheet 9A develops away-from-image curl upon leaving the nip part FN of the fixing part 5, as the plain paper sheet 9A passes through the decurling part 6, the away-from-image curl in the plain paper sheet 9A is corrected. The plain paper sheet 9A is thus substantially flattened. Then, the flattened plain paper sheet 9A is eventually received by the paper output receiving part 12 in substantially proper condition.

Figure 9:
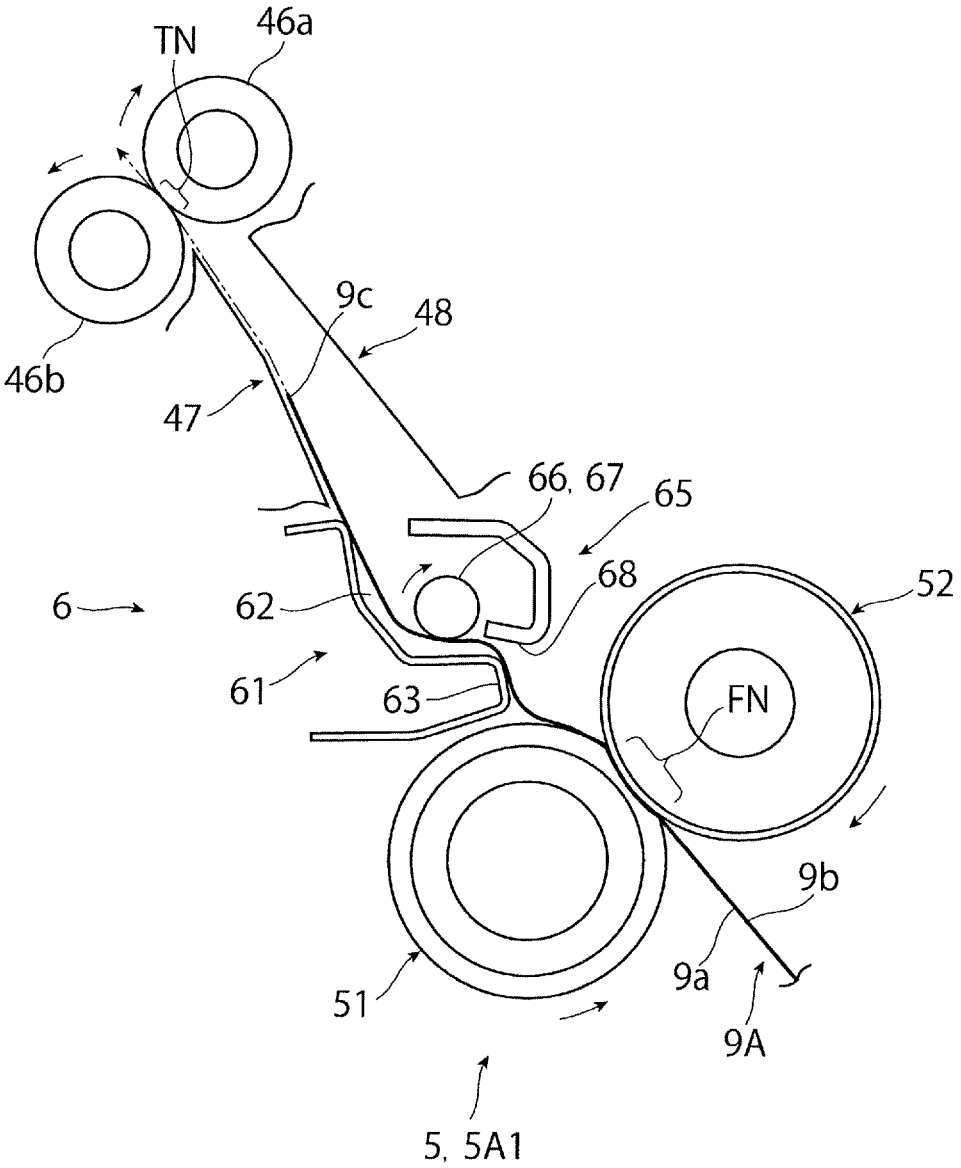
FIG. 9 schematically illustrates another operational state when decurling is applied to a curled plain paper sheet in a decurling part.
Figure 11:
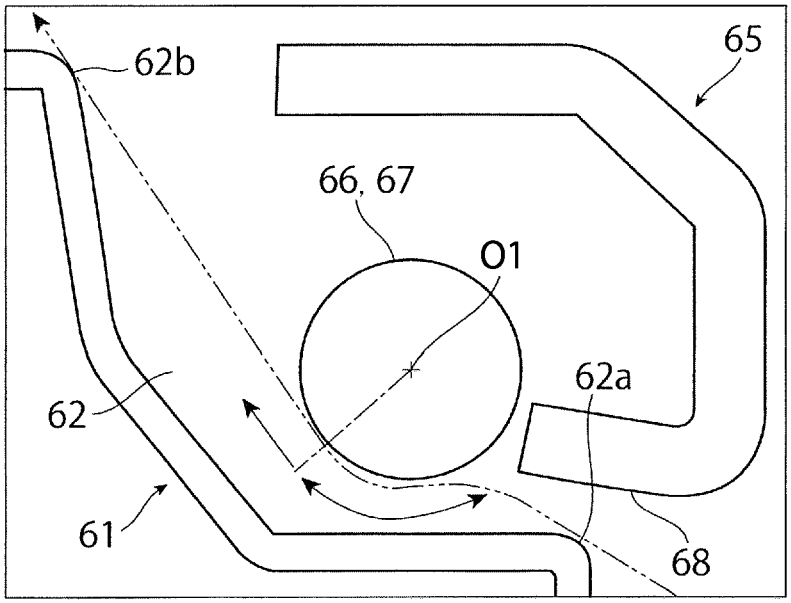
FIG. 11 schematically illustrates, in enlarged view, features such as structural portions of a decurling part that apply decurling.

In particular, as illustrated in FIG. 9, 11, or other figures, the decurling part 6 is able to temporarily deform the plain paper sheet 9A by bending the plain paper sheet 9A so as to warp toward the front side 9*a*. This bending deformation is applied in the area where the recess 62 and the roller 67 serving as the bending part 66 face each other (the area indicated by the two-direction arrow in FIG. 11) and which is located upstream, with respect to the transport direction C of the sheet 9, of the midpoint position of the transport path (discharge transport path Rt2) extending between the nip part FN of the fixing part 5 and the nip part TN of the pair of discharge rollers 46. This configuration allows for easy correction of away-from-image curl in the plain paper sheet 9A. The two-dot chain line with an arrow in FIG. 11 indicates the state (trajectory) of transport of the plain paper sheet 9A.

As illustrated in FIG. 11, in an area of the decurling part 6 located downstream of the roller 67 of the bending part 66 with respect to the transport direction C of the sheet 9 (the area downstream of the position indicated by the one-direction arrow), the decurling part 6 does not apply bending deformation to the sheet 9 that causes the sheet 9 to warp toward the front side 9*a*. This helps prevent away-from-image curl from being induced in the plain paper sheet 9A again in this area.

For cases where a type of paper sheet other than the plain paper sheet 9A, for example, a heavy paper sheet is used as the sheet 9, the decurling part 6 operates in substantially the same manner as when the plain paper sheet 9A is used.

That is, when a heavy paper sheet used as the sheet 9 passes through the nip part FN1 of the upward discharge-type fixing part 5A1 with type-1 nip, the heavy paper sheet leaving the nip part FN1 is free from the away-from-image curl (91) that would occur in the plain paper sheet 9A.

In this case, the heavy paper sheet is bent to warp toward its front side when passing through the gap between the recess 62 of the first guide unit 61 and the roller 67 serving as the bending part 66 of the second guide unit 65 in the decurling part 6. At this time, since the heavy paper sheet has a higher stiffness (rigidity) than a plain paper sheet, the heavy paper sheet is not kept in this bent state.

After passing through the decurling part 6, the heavy paper sheet is directed into the transport passage defined by the discharge guide units 47 and 48. Subsequently, the heavy paper sheet is transported to eventually reach the pair of discharge rollers 46 that rotates. The heavy paper sheet is then received in the paper output receiving part 12.

Accordingly, although the decurling part 6 acts to bend the sheet 9 toward the front side of the sheet 9 also when a heavy paper sheet passes through the decurling part 6 as the sheet 9, there is no risk of the decurling part 6 giving, for example, toward-image-curl to the heavy paper sheet at this time.

In the decurling part 6, the bending part 66 of the second guide unit 65 is disposed facing the recess 62 of the first guide unit 61 with a spacing S provided between the bending part 66 and the recess 62 to allow passage of the sheet 9. This configuration allows for easy passage and transport of the sheet 9 as compared to when the spacing S is not provided.

In the decurling part 6, the bending part 66 is positioned offset toward the upstream portion of the recess 62 with respect to the transport direction C of the sheet 9. This configuration helps properly correct curl (away-from-image curl) occurring at least in the leading end portion of the sheet 9 (plain paper sheet 9A), as compared to when the bending part 66 is positioned offset toward the downstream portion of the recess 62 with respect to the transport direction C of the sheet 9.

Further, in the decurling part 6, the bending part 66 is implemented as the roller 67, which is a rotator with a circular cross-section. As compared to when the bending part 66 is not formed as a rotator, this configuration allows for easy passage and transport of the sheet 9 and also reduces the load applied to the sheet 9 upon contact of the sheet 9 with the roller 67.

The roller 67 serving as the bending part 66 is disposed such that its center of rotation O1 does not lie inside the recess 62. As compared to disposing the roller 67 with its center of rotation O1 lying inside the recess 62, a relatively smaller portion of the sheet 9 is pushed into the recess 62 when passing the roller 67. This helps minimize poor sheet transport that occurs when the sheet 9 does not readily pass between the roller 67 and the recess 62.

Modification of Exemplary Embodiment 1

Figure 12:
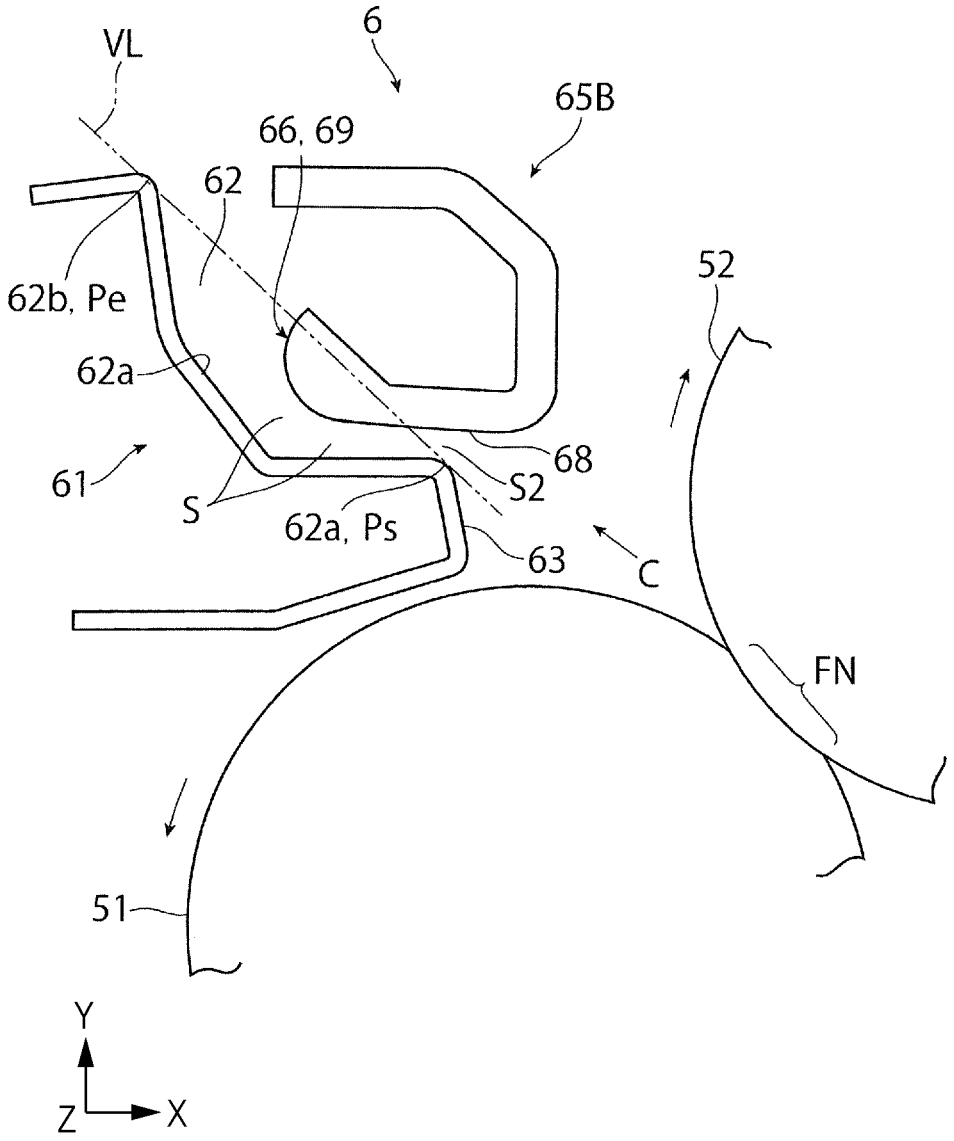
FIG. 12 schematically illustrates another exemplary configuration of a second guide unit of a decurling part.

As illustrated in FIG. 12, the decurling part 6 according to Exemplary Embodiment 1 may employ a second guide unit 65B as the second guide unit 65. The bending part 66 serving as a guide part of the second guide unit 65B is a stationary bending part 69 that does not rotate.

The semi-perimeter portion of the circular column or circular cylinder forming the stationary bending part 69 of the second guide unit 65B faces the recess 62 of the first guide unit 61. The stationary bending part 69 is substantially identical in configuration to the roller 67 serving as the bending part 66 according to Exemplary Embodiment 1, except that the stationary bending part 69 does not rotate.

With the second guide unit 65B having the stationary bending part 69, the lead-in part 68 may be provided contiguous with the stationary bending part 69.

The first guide unit 61 according to this modification is identical in configuration to the first guide unit 61 according to Exemplary Embodiment 1.

The decurling part 6 including the second guide unit 65B with the stationary bending part 69 according to this modification provides substantially the same operational effect as the decurling part 6 according to Exemplary Embodiment 1.

Exemplary Embodiment 2

Figure 13:
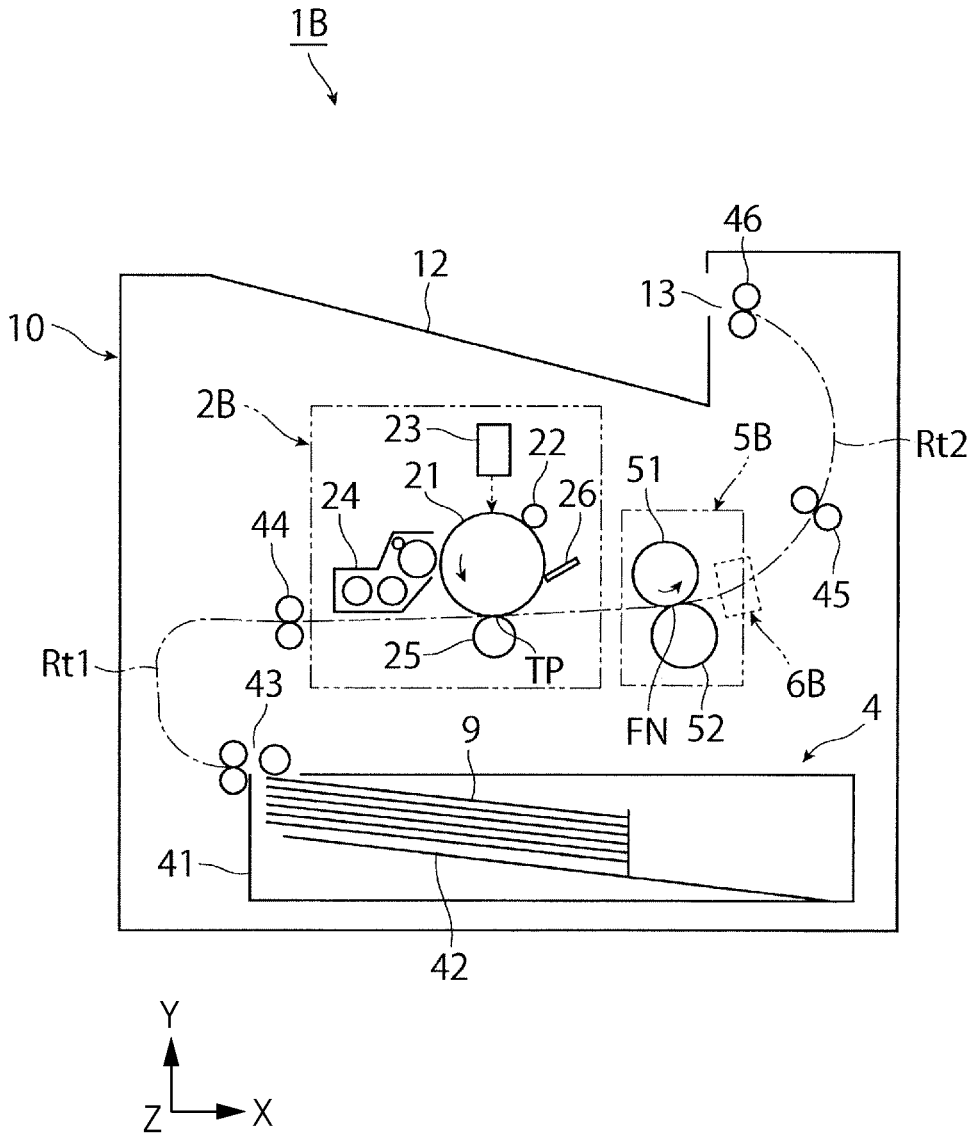
FIG. 13 schematically illustrates the general arrangement of an image forming apparatus according to Exemplary Embodiment 2.
Figure 14:
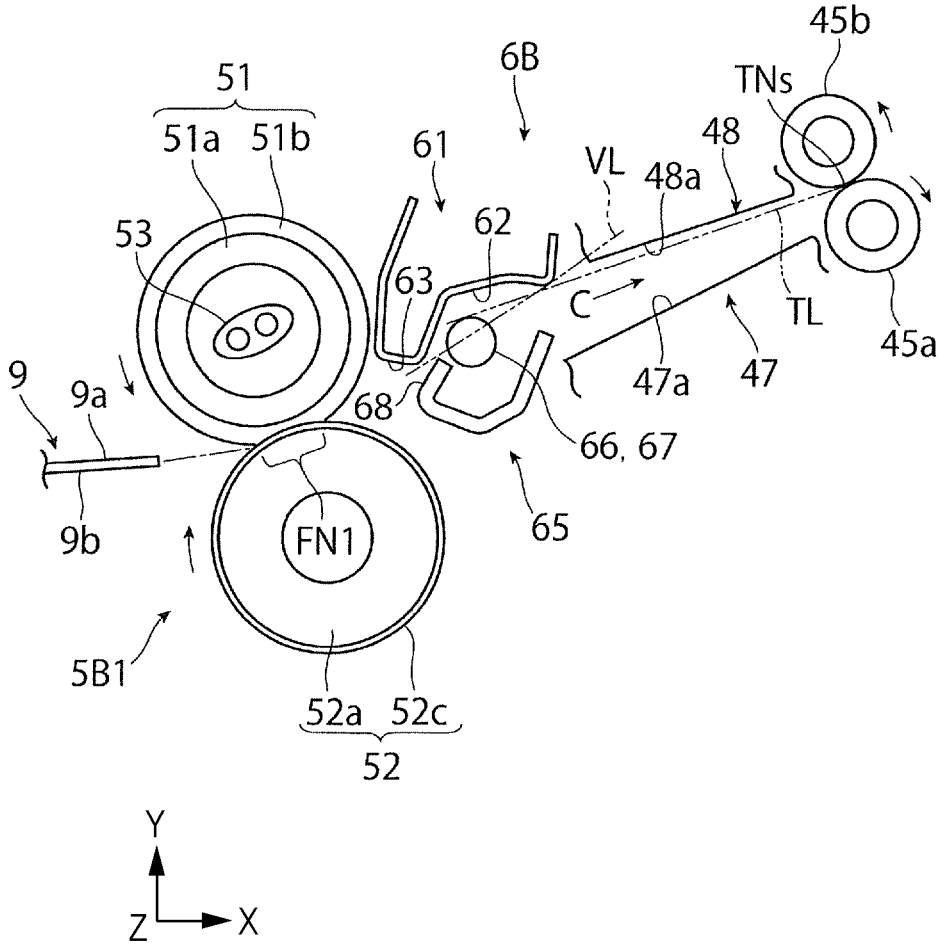
FIG. 14 schematically illustrates a portion (mostly a fixing part and a decurling part) of the image forming apparatus illustrated in FIG. 13.

FIGS. 13 and 14 illustrate an image forming apparatus 1B according to Exemplary Embodiment 2. FIG. 13 illustrates the configuration of the entire image forming apparatus 1B, and FIG. 14 illustrates the configuration of a portion (mostly a fixing part and a decurling part) of the image forming apparatus 1B.

As illustrated in FIG. 13, substantially like the image forming apparatus 1 according to Exemplary Embodiment 1, the image forming apparatus 1B includes, for example, the following components disposed inside the housing 10: an image forming part 2B, the paper feed part 4, a fixing part 5B, and a decurling part 6B that corrects curl in the sheet 9 discharged from the fixing part 5B.

Among the above-mentioned components, the image forming part 2B is identical in configuration to the image forming part 2 according to Exemplary Embodiment 1, except that after a transfer process, the image forming part 2B discharges the sheet 9 in substantially the lateral direction from the transfer position TP.

The fixing part 5B is substantially identical in configuration to the fixing part 5 according to Exemplary Embodiment 1, except that after performing a fixing process on the sheet 9, the fixing part 5B discharges the sheet 9 from the nip part FN in substantially the lateral direction (e.g., in a direction falling within a range of ±45 degrees with respect to the horizontal direction of the floor or other surfaces on which the image forming apparatus is placed). In the following description, the fixing part 5B that discharges a sheet in this manner will be sometimes also referred to as "lateral discharge-type fixing part 5B".

Further, substantially like the fixing part 5 according to Exemplary Embodiment 1, the lateral discharge-type fixing part 5B is also a fixing part with type-1 nip illustrated in FIG. 17A. Accordingly, in the following description, the above-mentioned lateral discharge-type fixing part 5B will be sometimes also referred to as "lateral discharge-type fixing part 5B1 with type-1 nip".

Further, as illustrated in FIG. 13, the image forming apparatus 1B is additionally provided with a pair of transport rollers 45 disposed in the discharge transport path Rt2 between the fixing part 5B and the discharge rollers 46. The transport rollers 45 serve as a pair of transport rollers that first pinches and transports the sheet 9 after the sheet 9 leaves the nip part FN of the fixing part 5B.

The image forming apparatus 1B according to Exemplary Embodiment 2 employs, as the decurling part 6B, a decurling part having the configuration described below.

First, substantially like the decurling part 6 according to Exemplary Embodiment 1 (including its modification), the decurling part 6B includes the first guide unit 61 and the second guide unit 65. The only slight difference of the decurling part 6B from the decurling part 6 is that the relative positions of the first guide unit 61 and second guide unit 65 with respect to the vertical direction are reversed from those in the decurling part 6.

As illustrated in FIG. 14, the first guide unit 61 of the decurling part 6B comes into contact with the front side 9*a* of the sheet 9 leaving the nip part FN1 of the lateral discharge-type fixing part 5B to thereby guide the transport of the sheet 9. Substantially like the first guide unit 61 of the decurling part 6 according to Exemplary Embodiment 1, the guide part of the first guide unit 61 of the decurling part 6B includes the recess 62 and the directing part 63.

As illustrated in FIG. 14, the second guide unit 65 of the decurling part 6B comes into contact with the back side 9*b* opposite to the front side 9*a* of the sheet 9 leaving the nip part FN1 of the lateral discharge-type fixing part 5B to thereby guide the transport of the sheet 9. Substantially like the second guide unit 65 of the decurling part 6 according to Exemplary Embodiment 1, the guide part of the second guide unit 65 of the decurling part 6B includes the roller 67 of the bending part 66, and the lead-in part 68.

The decurling part 6B described above provides, for the sheet 9 leaving the nip part FN1 of the lateral discharge-type fixing part 5B1 with type-1 nip, substantially the same operational effect as that of the decurling part 6 according to Exemplary Embodiment 1. In particular, when the plain paper sheet 9A develops away-from-image curl upon leaving the nip part FN1, the away-from-image curl is corrected as the plain paper sheet 9A passes through the decurling part 6B.

OTHER MODIFICATIONS

The present disclosure is by no means limited to the details set forth in Exemplary Embodiments 1 and 2 above but includes, for example, the following modifications in its scope.

As illustrated in FIG. 15, the image forming apparatus 1 according to Exemplary Embodiment 1 may employ, instead of the fixing part 5, an upward discharge-type fixing part 5A2 with type-2 nip illustrated in FIG. 17B.

As illustrated in FIG. 15, a decurling part 6C used when the upward discharge-type fixing part 5A2 with type-2 nip is employed includes the first guide unit 61 and the second guide unit 65, substantially like the decurling part 6 according to Exemplary Embodiment 1 (including its modification).

However, the decurling part 6C differs from the decurling part 6 according to Exemplary Embodiment 1 in that the first guide unit 61 is disposed to lie mostly on the same side as the pressure rotator 52 with respect to the nip part FN2 of the fixing part 5A2, and that the second guide unit 65 and the bending part 66 are disposed to lie on the same side as the heat rotator 51 of the fixing part 5A2. The fixing part 5A2 is desirably provided with a stripping guide unit (not illustrated) disposed between the nip part FN2 and the second guide unit 65 of the decurling part 6C to strip the leading end 9*c* of the sheet 9 from the heat rotator 51 after a transfer process and then guide the leading end 9*c* of the sheet 9 toward the lead-in part 68 of the second guide unit 65.

Figure 16:
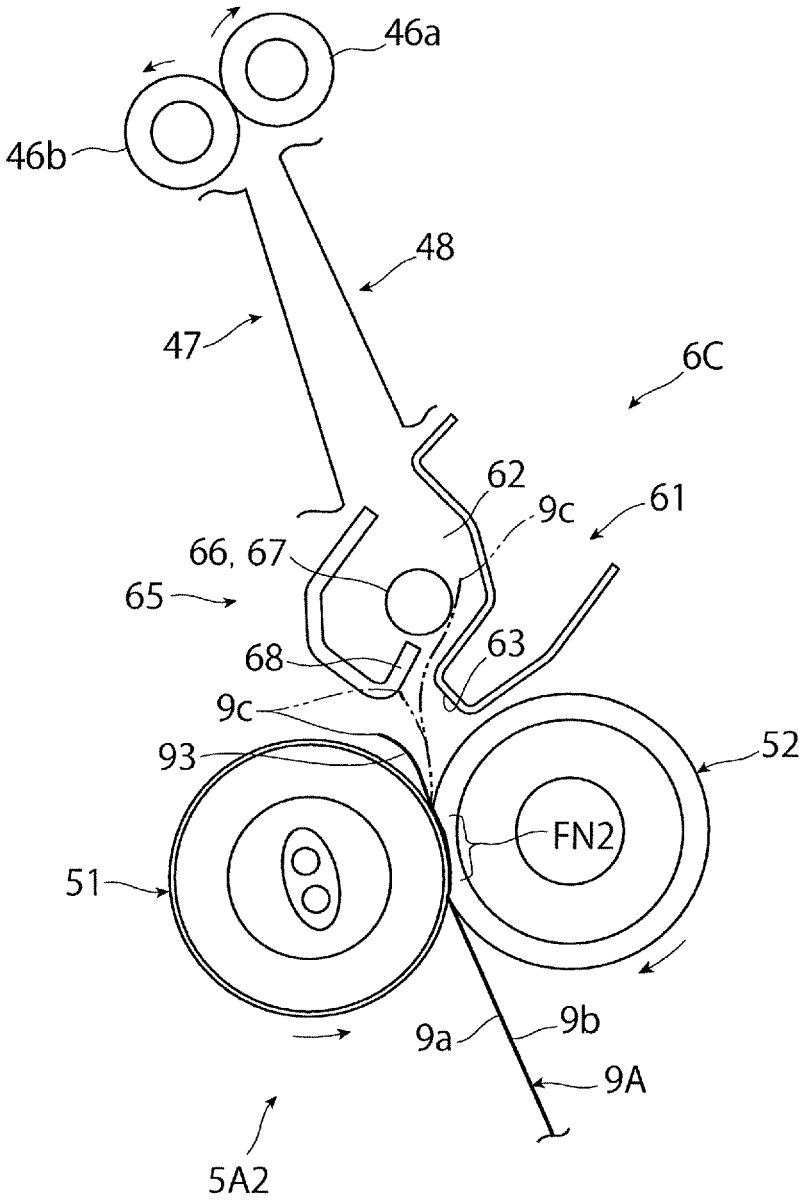
FIG. 16 schematically illustrates an operational state when a curled plain paper sheet is led into the decurling part illustrated in FIG. 15, and an operation state when decurling is applied in the decurling part.

With the image forming apparatus employing the upward discharge-type fixing part 5A2 with type-2 nip, if the plain paper sheet 9A is used as the sheet 9, the plain paper sheet 9A leaving the nip part FN2 of the fixing part 5A2 may sometimes develop a toward-image curl 93 as indicated by the thick solid line in FIG. 16 such that the plain paper sheet 9A bends so as to warp toward the front side 9*a*.

At this time, for the plain paper sheet 9A leaving the nip part FN2 of the fixing part 5A2 and having the toward-image curl, the decurling part 6C applies the following action to not only the leading end portion but also the trailing portion of the plain paper sheet 9A. That is, as the plain paper sheet 9A is passed through the gap between the recess 62 of the first guide unit 61 and the roller 67 serving as the bending part 66 of the second guide unit 65, the decurling part 6C temporarily bends the plain paper sheet 9A into a curved shape that warps toward the back side 9*b*. This corrects the toward-image curl in the plain paper sheet 9A so that the toward-image curl substantially disappears.

If a heavy paper sheet 9B is used as the sheet 9, the decurling part 6C operates in substantially the same manner as the decurling part 6 according to Exemplary Embodiment 1.

The image forming apparatus 1B according to Exemplary Embodiment 2 may employ, instead of the lateral discharge-type fixing part 5B1 with type-1 nip, a lateral discharge-type fixing part (5B2) having the nip part FN2 that is a type-2 nip part.

Further, if necessary, the bending part 66 of the second guide unit 65 in the decurling part 6 (6B or 6C) may be disposed in proximity to or in contact with the recess 62 of the first guide unit 61. In this case, from the viewpoint of allowing easy transport of the sheet 9 passing between the recess 62 and the bending part 66, for example, the bending part 66 may be formed as a rotator such as the roller 67 that is rotatable, or the guide surface 62*c* of the recess 62 or the surface of the bending part 66 may be provided with a surface layer that is readily capable of elastic deformation.

Further, the decurling part 6 (6B or 6C) may include, instead of the directing part 63 of the first guide unit 61, a stripping guide unit disposed between the first guide unit 61 and the heat rotator 51 (or the pressure rotator 52) to strip the sheet 9 and guide the stripped sheet 9 to areas such as the lead-in part 68 or the bending part 66 of the second guide unit 65.

Further, although the image forming apparatus 1 or 1B according to Exemplary Embodiment 1 or 2 mentioned above includes the image forming part 2 or 2B that forms a monochrome image by use of developer, the image forming apparatus 1 or 1B may be an image forming apparatus including the image forming part 2 or 2B that forms a multi-color image. The above-mentioned image forming part 2 or 2B that forms a multi-color image may be, for example, an image forming part having a body portion that forms unfixed images of various colors, and an intermediate transfer portion used for a first transfer process and a second transfer process, the first transfer process transferring each unfixed image onto the intermediate transfer portion, the second transfer process transferring each transferred unfixed image carried by the intermediate transfer portion to the sheet.

In the foregoing description of Exemplary Embodiments 1 and 2, the fixing part 5 (5A or 5B) includes the heat rotator 51 and the pressure rotator 52 that are of a roller type. Alternatively, the fixing part 5 (5A or 5B) may have a configuration such that one or both of the heat rotator 51 and the pressure rotator 52 are of a belt-support roller type or of a belt-nip type.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

fixing means for transporting a sheet of paper carrying an unfixed image through a nip part to fix the unfixed image to the sheet, the nip part applying heat and pressure to the sheet;

a pair of transport rollers that first pinches and transports the sheet after the sheet leaves the nip part of the fixing means;

a first guide means for guiding transport of the sheet, the first guide means coming into contact with a first side of the sheet at a position closer to the fixing means than is the pair of transport rollers after the sheet leaves the nip part; and a second guide means for guiding transport of the sheet, the second guide means coming into contact with a second side of the sheet at a position closer to the fixing means than is the pair of transport rollers after the sheet leaves the nip part, the second side being opposite to the first side, wherein the first guide means has a recess serving as a guide part, the recess being recessed in a direction away from a transport path of the sheet, and wherein the second guide means has a bending part serving as a guide part, the bending part having a shape of a circular arc in cross-section, the bending part being disposed such that at least a portion of the bending part lies inside the recess.

2. An image forming apparatus comprising:

a fixing unit that transports a sheet of paper carrying an unfixed image through a nip part to fix the unfixed image to the sheet, the nip part applying heat and pressure to the sheet;

a pair of transport rollers that first pinches and transports the sheet after the sheet leaves the nip part of the fixing unit;

a first guide unit that guides transport of the sheet, the first guide unit coming into contact with a first side of the sheet at a position closer to the fixing unit than is the pair of transport rollers after the sheet leaves the nip part; and a second guide unit that guides transport of the sheet, the second guide unit coming into contact with a second side of the sheet at a position closer to the fixing unit than is the pair of transport rollers after the sheet leaves the nip part, the second side being opposite to the first side, wherein the first guide unit has a recess serving as a guide part, the recess being recessed in a direction away from a transport path of the sheet, and wherein the second guide unit has a bending part serving as a guide part, the bending part having a shape of a circular arc in cross-section, the bending part being disposed such that at least a portion of the bending part lies inside the recess.

3. The image forming apparatus according to claim 2, wherein the bending part is disposed facing the recess with a spacing provided between the bending part and the recess to allow passage of the sheet.

4. The image forming apparatus according to claim 3, wherein the bending part is positioned toward a downstream portion of the recess with respect to a sheet transport direction.

5. The image forming apparatus according to claim 2, wherein the bending part of the second guide unit comprises a rotator disposed in a rotatable manner and having a circular shape in cross-section.

6. The image forming apparatus according to claim 5, wherein the rotator of the bending part is disposed such that a center of rotation of the rotator does not lie inside the recess.

7. The image forming apparatus according to claim 2, wherein the second guide unit has a lead-in part serving as a guide part, the lead-in part being disposed upstream of the bending part with respect to a sheet transport direction to guide the sheet to the bending part.

8. The image forming apparatus according to claim 7, wherein the lead-in part is disposed such that the lead-in part does not lie inside the recess.

9. The image forming apparatus according to claim 7, wherein the first guide unit has a directing part serving as a guide part, the directing part being disposed at an upstream end portion of the recess with respect to the sheet transport direction to direct a leading end of the sheet into contact with the lead-in part of the second guide unit.

10. The image forming apparatus according to claim 2, wherein a downstream end portion of the recess with respect to a sheet transport direction is positioned in a direction away from the transport path of the sheet relative to a tangent line, the tangent line being tangent to the bending part and to an entrance of a nip part formed by the pair of transport rollers.

11. The image forming apparatus according to claim 2, wherein each of the first guide unit and the second guide unit extends continuously over an entire area in a width direction of the sheet that intersects a sheet transport direction.

* * * * *